US007562746B2

(12) United States Patent
Yoshikawa et al.

(10) Patent No.: US 7,562,746 B2
(45) Date of Patent: Jul. 21, 2009

(54) METHOD, SYSTEM, AND DISPLAY FOR ELEVATOR ALLOCATION USING MULTI-DIMENSIONAL COORDINATES

(75) Inventors: Toshifumi Yoshikawa, Hitachinaka (JP); Satoru Toriyabe, Hitachinaka (JP); Takamichi Hoshino, Hitachinaka (JP); Shunichi Tanae, Mito (JP); Atsuya Fujino, Hitachinaka (JP); Ryou Okabe, Hitachinaka (JP); Masaya Furuhashi, Hitachinaka (JP); Kenji Yoneda, Hitachinaka (JP)

(73) Assignees: Hitachi, Ltd., Tokyo (JP); Hitachi Mito Engineering Co., Ltd., Hitachinaka-shi (JP)

( * ) Notice: Subject to any disclaimer, the term of this patent is extended or adjusted under 35 U.S.C. 154(b) by 512 days.

(21) Appl. No.: 11/356,234

(22) Filed: Feb. 17, 2006

(65) Prior Publication Data

US 2006/0249335 A1 Nov. 9, 2006

(30) Foreign Application Priority Data

May 6, 2005 (JP) ..... 2005-134932

(51) Int. Cl.
*B66B 1/18* (2006.01)

(52) U.S. Cl. ..... 187/382; 187/247

(58) Field of Classification Search ..... 187/247, 187/380–389

See application file for complete search history.

(56) References Cited

U.S. PATENT DOCUMENTS 4,982,817 A 1/1991 Tsuji
5,354,957 A * 10/1994 Robertson ..... 187/247
6,672,431 B2 * 1/2004 Brand et al. ..... 187/382
7,014,015 B2 * 3/2006 Nikovski et al. ..... 187/382

FOREIGN PATENT DOCUMENTS

| | | | |
|---|---|---|---|
| JP | 1-192682 | A | 8/1989 |
| JP | 7-72059 | A | 4/1990 |
| JP | 5-319707 | A | 12/1993 |
| JP | 7-117941 | A | 5/1995 |
| JP | 10-245163 | A | 9/1998 |

OTHER PUBLICATIONS

Kurosawa et al., "Intelligent and Supervisory Control for Elevator Group", The Transactions of Information Processing Society of Japan, vol. 26, No. 2, Mar. 1985, pp. 278-287, including English translation thereof.

* cited by examiner

*Primary Examiner*—Jonathan Salata
(74) *Attorney, Agent, or Firm*—Crowell & Moring LLP

(57) ABSTRACT

A method and a display for elevator allocation evaluating are provided. When an elevator allocated to a hall call is selected by employing two different view points such as a real and a future call evaluation index, an elevator allocation reason and a balance between the two view points can be easily grasped. An elevator allocated to a hall call is evaluated on orthogonal coordinates in which the real call evaluation index and the future call evaluation index are defined as an X and a Y coordinate axis. Evaluation indexes of first to fourth elevator cars are evaluated by employing contour lines of a synthetic evaluation function, which is represented as the real and the future call evaluation index. A weight for allocating is displayed visually.

8 Claims, 18 Drawing Sheets

METHOD, SYSTEM, AND DISPLAY FOR ELEVATOR ALLOCATION USING MULTI-DIMENSIONAL COORDINATES

BACKGROUND OF THE INVENTION

The present invention generally relates to an elevator group supervisory control method, an elevator group supervisory control system, and a display apparatus for an elevator group supervisory control system. More specifically, the present invention is directed to an allocation control for determining an elevator with respect to a produced hall call, and also, directed to evaluation of the allocation control.

Elevator group supervisory control systems may provide elevator operating services in more effective manners with respect to users by handling a plurality of elevators as one group. Concretely speaking, while the plural elevators are supervised as one group, in the case that a hall call is produced at a certain floor, a single optimum elevator cage is selected from this elevator group, and the hall call is allocated to this selected elevator cage.

As indexes for allocating a produced hall call to which elevator, allocation evaluation functions are employed. As conventional technical ideas using the allocation evaluation functions, the below-mentioned examples are exemplified:

1). JP-B-7-72059 discloses an allocation evaluation control in which a temporally equi-interval condition is employed as an index.

2). Kurosawa et al., "Intelligent and Supervisory Control for Elevator Group", The Transactions of Information Processing Society of Japan, Vol. 26, No. 2, March in 1985, pages 278 to 287, and JP-A-10-245163 describe allocation evaluation controls in which service distribution indexes are employed.

3). JP-A-5-319707 describes an allocation evaluation control executed by considering a waiting time caused by a virtual call.

4). JP-A-7-117941 describes an allocation evaluation control executed by considering an operating scheme evaluation value.

Also, JP-A-1-192682 discloses such an example that with respect to three control targets such as a waiting time, a riding time, and a passenger crowded degree within an elevator cage, important degrees as to these 3 control targets are represented in a radar chart.

The ideas of the above-explained conventional techniques can be summarized as such an idea using an evaluation index to which the below-mentioned two evaluation indexes are weight-added.

(1) An evaluation index based upon a predicted waiting time with respect to a real call (both a new hall call, and a previously issued hall call for not-yet-provided service), (2-1) an evaluation index based upon fluctuation degrees (for example, interval distribution of respective elevator cages) as to intervals of respective elevator cages, (2-2) an evaluation index based upon a predicted arrival time with respect to a potential call, (2-3) an evaluation index using a predicted waiting time of a virtual call, or (2-4) an evaluation index related to an equal condition of temporal intervals.

The latter-mentioned evaluation indexes (2-1) to (2-4) among the above-explained evaluation indexes correspond to evaluation indexes related to hall calls in the future, and thus, these evaluation indexes (2-1) to (2-4) will be referred to as "evaluation indexes related to future calls" hereinafter. When this expression is employed, the conventional techniques may be expressed by that such an evaluation function is employed to which an evaluation index value related to a real call and an evaluation index value related to a future call are weight-added.

Also, the radar chart of JP-A-1-192682 represents coefficients of allocation evaluation formulae in the relevant time range, or the traffic flow in the building. However, this radar chart does not indicate the allocation basis with respect to the respective calls. Concretely speaking, this radar chart shows the weighting coefficients (importance degrees) of the controls which are uniformly effected with respect to all of the calls within the relevant time range. For example, with respect to a call (e.g., call of 8-th floor UP direction) produced at a certain time instant, the radar chart represents contents of allocation evaluation values of the respective elevator cages, but does not represent why a second elevator cage is allocated to this call.

In the case that the evaluation functions based upon such numeral values are employed, there is a problem that the decision reason of the allocation evaluation can be hardly grasped at first glance. In other words, the correspondence condition and the relative condition between the real call evaluation index values and the future call evaluation index values as to the respective elevators cannot be understood at first glance. As a result, there are some difficulties in such a case that designers, maintenance service men, supervisors, and the like will check validity of the allocation results in later. Also, there are some cases that the allocation reason of these elevators is questioned from users of the building. Similarly, it is difficult to make up an easily understandable explanation as to the elevator allocation reason.

In an actual background, the future call evaluation index has been recognized only as the auxiliary role. In case of elevators, future calls implies such a random phenomenon that occurrences of these future calls can be hardly predicted, and therefore, it is practically difficult to predict that persons present in a building push hall call buttons for which floor directions at what time (hours, minutes, and seconds) and at which floors. As a consequence, such an idea that a user who has being requested a service is handled at a top priority is actually acceptable. Namely, it is apparently an acceptable idea that the real call evaluation index is mainly employed. However, very recently, since personal identification techniques using IC tags and the like are developed and image processing techniques using cameras are popularized, such an environment capable of detecting flows of persons within buildings in advance is being established. As a result, it is predictable that the future call evaluation index will be taken very seriously in near future, as compared with the real call evaluation index. In other words, as to the allocation index in near future, these two indexes (namely, both real call evaluation index and future call evaluation index) are equivalently handled. Then, the following aspects may surely become important ideas, that is, how to evaluate both the real call evaluation index and the future call evaluation index, while how to balance these two evaluation indexes. Then, it is also important to represent contents of these two evaluation in an easily understandable manner.

An object of the present invention is to provide an elevator group supervision control method, an elevator group supervision control system, or a display apparatus for the elevator group supervision control system, by which elevator allocation is carried out, while relative conditions among a plurality of evaluation indexes having different view points such as a real call evaluation index and a future call evaluation index can be readily grasped, and also, a balance of the respective view points can be easily understood.

Another object of the present invention is to provide a method, a system, or a display apparatus, capable of readily evaluating an allocation control with employment of a plurality of evaluation indexes having different view points, while relative conditions of the respective evaluation indexes with respect to the respective elevators, and also, a balance of the respective view points can be understood at first glance.

SUMMARY OF THE INVENTION

An aspect of the present invention is featured by that an elevator which is allocated to an issued hall call is evaluated by multi-dimensional coordinates in which a plurality of allocation evaluation indexes having different view points are defined as coordinate axes, respectively.

Another aspect of the present invention is featured by that an elevator which is allocated to an issued hall call is evaluated by orthogonal two-axis coordinates in which a real call evaluation index and a future call evaluation index are defined as coordinate axes, respectively.

A further aspect of the present invention is featured by that in addition to the above-described orthogonal coordinates, the elevator to be allocated is evaluated by employing a contour line of a synthetic evaluation function which is expressed as a function between the real call evaluation index and the future call evaluation index.

In a preferable embodiment of the present invention, respective elevators are provisionally allocated with respect to a newly produced hall call, and then, both real call evaluation index values and future call evaluation index values are calculated. The real call evaluation index values are, for example, predicted waiting times and the like with respect to the newly produced hall call. In this case, a future call evaluation index value corresponds to such an evaluation index value, or the like, for instance, which indicates a fluctuation degree of intervals of the respective-elevator cages. The calculated two evaluation index values are indicated as evaluation results of the respective elevators so as to be represented as two-dimensional coordinate points in the above-described orthogonal coordinates.

Also, in a preferable embodiment of the present invention, a contour line of the synthetic evaluation function which is represented as the function between the real call evaluation index and the future call evaluation index is depicted on the above-explained coordinates.

In accordance with the preferable embodiment of the present invention, since the evaluation results of the respective elevators are indicated on the multi-dimensional coordinates, the correspondence conditions between the real call evaluation indexes and the future call evaluation indexes with respect to the evaluation results of the respective elevators can be displayed in a visible manner.

Also, in accordance with the preferable embodiment of the present invention, the value of the synthetic evaluation function which is expressed as the function between the two evaluation indexes is represented as the coordinate point on the two-dimensional coordinate for both the real call evaluation index and the future call evaluation index. As a result, relative conditions with respect to the two evaluation indexes, and the balance between the two evaluation indexes can be understood at first glance.

Furthermore, in accordance with the preferable embodiment of the present invention, the contour line of the synthetic evaluation function which is expressed as the function between the two evaluation indexes is represented on the two-dimensional coordinate for both the real call evaluation index and the future call evaluation index. As a result, weights for the two evaluation indexes can be displayed in a visual manner.

Since the above-explained allocation method is employed, such an allocation evaluating method can be realized which is capable of easily grasping the corresponding conditions and the relative conditions between the real call evaluation index and the future call evaluation index when the elevator to be allocated is selected. Also, since the evaluation indexes are evaluated on the orthogonal coordinates, such an evaluation capable of considering the balance between the two evaluation indexes can be realized.

Other objects and features of the present invention may becomes apparent from the descriptions in the below-mentioned embodiments.

DESCRIPTION OF THE INVENTION

First of all, a description is made of an allocation evaluating idea of elevators with respect to hall calls, which constitutes a basis of the present invention. In a group supervisory control system of elevators, while plural cars of elevators are handled as one group, a control operation is carried out in such a manner that one elevator which is judged as the most appropriate elevator is selected with respect to a newly produced hall call, and the selected elevator is allocated to this new hall call. In this elevator group supervisory control system, an index for judging the most appropriate elevator constitutes an allocation evaluation function.

A concrete allocating process is given as follows: First, each of the elevators within the group is provisionally allocated with respect to the newly produced hall call. Under this provisionally allocated condition, a predicted waiting time with respect to this new hall call is calculated. Then, the predicted waiting times with respect to the respective elevators are compared with each other, and the above-explained hall call is allocated to such an elevator whose predicted waiting time becomes the shortest waiting time. In this example, the respective predicted waiting times in the case that the respective elevators are provisionally allocated to the new hall call constitute evaluation functions. In addition to this example, there is another example. That is, a maximum value of predicted waiting times with respect to hall calls which are being accepted by the respective elevators may be used as an evaluation function, while the above-explained hall calls contain both the hall calls which have already been accepted by the respective elevators, and hall calls which are newly and provisionally allocated thereto. Since the allocation evaluating idea is conducted, an elevator which is conceivable as the most appropriate elevator can be selected from the plural elevators by executing the calculation.

Next, a first embodiment of the present invention will now be described with reference to drawings. FIG. 1 to FIG. 4 indicate drawings related to the first embodiment of the present invention, respectively.

Figure 1:
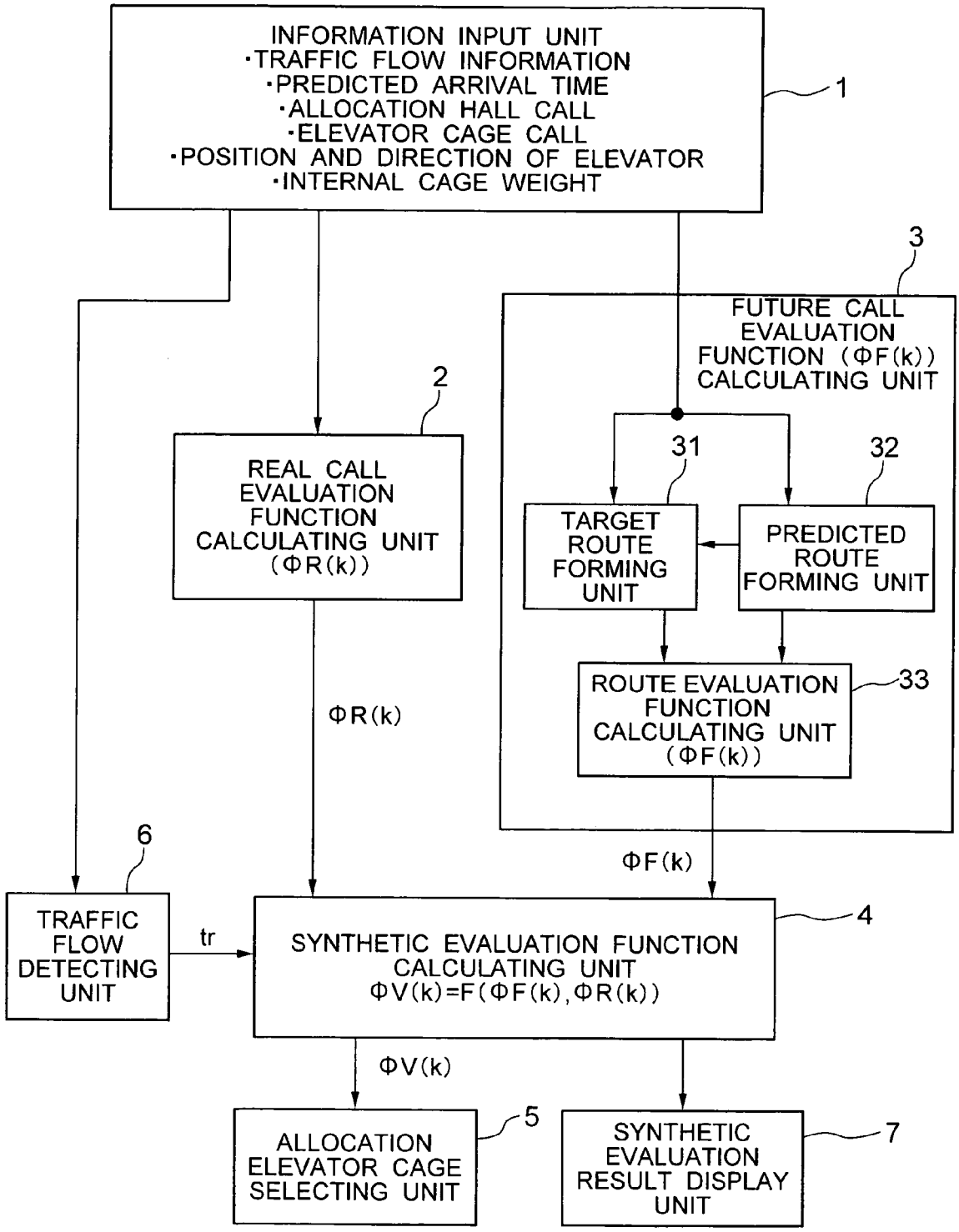
FIG. 1 is a control function block diagram of an elevator group supervisory control system according to a first embodiment of the present invention.

FIG. 1 is a control functional block diagram of an elevator group supervisory control system according to the first embodiment of the present invention. A flow of process operations executed in the control functional block of FIG. 1 is described as follows:

That is, the below-mentioned information which is required for control operations is inputted from an information input unit 1 of an elevator. Concretely speaking, the information corresponds to traffic flow information within a building, and control information with respect to each of elevators. The control information for every elevator contains arrival predicted time data to respective floors, allocated hall call information (floors, directions etc.), cage call information (floors, directions etc.), positional/directional information, internal cage weight (number of passenger) information, and the like. The above-described information is transferred to both an real call evaluation function calculating unit 2 and a future call evaluation function calculating unit 3.

In the actual evaluation function calculating unit 2, a value of a real call evaluation function "ΦR (K)" is calculated based upon the previously explained input information. A variable "K" represents that an elevator corresponds to a "K"-th elevator car. In this case, a "real call" implies a hall call which is actually produced. The "real call" indicates a hall call which has already been allocated to a predetermined elevator after this real call has been issued, or such a hall call which has been newly produced and has been provisionally allocated to each of elevators. As the real call evaluation function "ΦR (K)", various sorts of functions may be conceived. For instance, these functions correspond to a predicted waiting time in such a case that an elevator is provisionally allocated to a newly produced hall call, a squared value of this predicted waiting time, maximum values of predicted waiting times with respect to real calls which have been allocated to the respective elevators, an average value of these maximum values, or a mean squared value thereof, or the like. It is so conceivable that all of allocation indexes related to the real calls are contained in the real call evaluation function "ΦR (K)".

On the other hand, in the future call evaluation function calculating unit 3, a future call evaluation function "ΦF (K)" is calculated. It is so conceivable that a future call evaluation function contains all of allocation indexes related to hall calls which will be probably produced after the present time instant. For example, as this future call evaluation function ΦF (K), there is such an index which evaluates a degree of distance intervals, or a degree of time intervals as to the respective elevators, as viewed from a technical point that all of the elevators are operated in an equi-interval. Also, as this future call evaluation function ΦF (K), there is a virtual hall call, namely, an index for evaluating a predicted waiting time with respect to a hall call which is predicted to be produced in a future time instant. Furthermore, as the future call evaluation function ΦF (K), there is a potential hall call, namely a concept which is similar to the virtual hall call. The indexes and the like which evaluate predicted waiting times with respect to hall calls which continuously have considered all of floors with respect to the future time, correspond to the future call evaluation function "ΦF (K)".

In this case, a description is made of an evaluation index related to degrees of temporally equi-interval operations.

In such a case that degrees of temporally equi-intervals of the respective elevators are deteriorated, namely, the temporal intervals of the respective elevators are largely fluctuated, when a hall call is newly issued at a next time in a region where the temporal interval is large, there is a large possibility that this new hall call is brought into a long waiting condition. As a consequence, the index for evaluating the degree of the temporally equi-intervals corresponds to such an index that a possibility of an occurrence of a long waiting condition with respect to a future hall call is evaluated, and thus, constitutes an allocation index related to the future hall call.

In addition to this allocation index, in the future call evaluation function shown in FIG. 1, an example is represented in which route deviation between a future target route and a predicted route with respect to each of the elevators is determined as the future call evaluation function. Concretely speaking, a target route forming unit 31 forms a future target route (namely, locus for constituting target through which each elevator should passes in future) with respect to each of the elevators. Also, a predicted route forming unit 32 forms a predicted route (namely, predicted locus through which each elevator is predicted to pass under present condition) of each of the elevators. Deviation between these two routes is calculated by a route evaluation function calculating unit 33. This deviation between these routes is defined as a route evaluation function, and constitutes a target call evaluation function. Although a detailed content of allocation evaluation by this target will be explained later, the allocation evaluation is a method for controlling future call allocation of elevators, and consequently, constitutes a future evaluation function related to a future call.

In a synthetic evaluation function calculating unit 4, a synthetic evaluation function "ΦV (K)" is calculated by employing the real call evaluation function value "ΦR (K)" and the future call evaluation function value "ΦF (K)", which are calculated with respect to each of the elevators. The synthetic evaluation function "ΦV (K)" corresponds to such an evaluation function which finally determines an allocation of an elevator in an allocation cage selecting unit 5. This first embodiment is featured by this synthetic evaluation function and evaluation thereof. A detailed content of the evaluating method will be explained with reference to FIG. 2 and FIG. 3.

As values for determining the synthetic evaluation function "ΦV (K)", a parameter "tr" indicative of a traffic flow condition at this time, which is acquired from the traffic flow detecting unit 6 in addition to both the real call evaluation function value ΦR (K) and the future call evaluation function value ΦF (K). As the traffic flow condition parameter "tr", for example, label values of traffic flow modes (office-going-time mode, front-half lunch time mode, rear-half lunch time mode, office-leaving-time mode etc.), and a total number of persons moving among floors at this time are conceivable.

In the allocation cage selecting unit 5, synthetic evaluation values ΦV (K) of the respective elevators are compared with each other so as to be evaluated. For instance, the allocation cage selecting unit 5 allocates a new hall call to a k-th elevator car whose synthetic evaluation value ΦV (K) becomes the smallest value.

A synthetic evaluation result display unit 7 forms a display apparatus used for an elevator group supervisory control system, and displays a content of allocation evaluation by synthetic evaluation. It should be noted that this display content is the major feature of this first embodiment, and a detailed display content will be explained with reference to FIG. 2 and FIG. 3.

Figure 2:
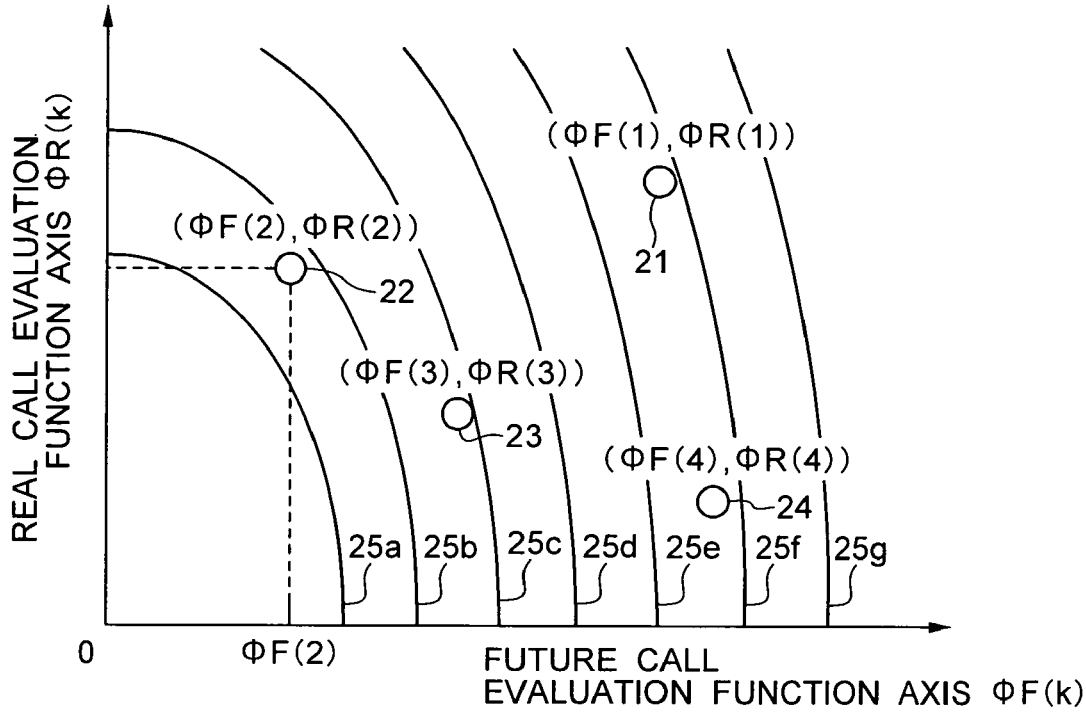
FIG. 2 is a graph for graphically representing a hall call allocating method according to the first embodiment of the present invention.

FIG. 2 is a graph for graphically showing a hall call allocating method according to the first embodiment of the present invention, and this graph directly constitutes a screen displayed by the display unit 7. A point of this graph is featured by that evaluation indexes of the respective elevators are evaluated on orthogonal coordinates where the evaluation indexes are employed as coordinate axes. Before explaining the graph of FIG. 2, the problems as to the conventional allocation evaluating method are classified.

The conventional allocation evaluating method evaluates the evaluation indexes based upon the weighting linear summation of the plural allocation evaluation indexes. For example, assuming now that an index of a predicted waiting time with respect to a new hall call is equal to "Φ1 (K)", an index of a temporal interval among the respective elevators is equal to "Φ2 (K)", and a weighting coefficient is equal to "α", a synthetic evaluation function "ΦT (K)" expressed by the following expression (1) corresponds to one of typical examples of the evaluating method.

$$\Phi T(K)=\Phi 1(K)+\alpha X\Phi 2(K) \tag{1}$$

A problem as to this evaluating method is given as follows: That is, since the evaluation result is expressed only by the numeral values, a mechanism for achieving this evaluation result can be hardly grasped. This may cause a very large problem. For example, in such a case that a check and investigation are made as to whether or not allocation to a certain elevator is proper by eyes of a person, this person must judge the appropriate allocation based upon the rounded final numeral value, for example, Φ (K=2)=30. As a result, the person can hardly judge the appropriate allocation only by this information. Also, there is another method for analyzing the index values of ΦT (K), Φ1 (K), Φ2 (K), and the weight coefficient "α" with respect to each of the elevators (K). However, in order that the above-explained information with respect to all of the hall calls is listed up one by one so as to be analyzed one by one, very heavy work loads are necessarily required which never constitutes a realistic solution. In other words, the presently available allocating method constitutes the method which can be hardly grasped by the human check.

As previously explained, as a consequence, allocation evaluation in the future owns the following important aspects. That is, while a real call evaluation index and a future call evaluation index are handled as equivalent indexes, it is important how to balance and evaluate both these real and future call evaluation indexes. Then, it is also important how to display a content of this evaluation in an easy manner. It should be understand that a future call evaluation method to which a target route is applied (will be explained later) corresponds to a control method capable of effectively evaluating a future call, and in order to more effectively utilize capability of this control, such a method capable of easily evaluating a balance between the future call evaluation and the real call evaluation is desirably expected.

The allocation evaluating method shown in FIG. 2 corresponds to an allocation evaluating method capable of solving the above-described problem, and is featured by the allocation evaluation with employment of the orthogonal coordinate system. In this drawing, two axes of the orthogonal coordinate system are represented, a future call evaluation function "ΦF (K)" is indicated in an abscissa thereof, and a real call evaluation function "ΦR (K)" is indicated in an ordinate thereof. In this first embodiment, while a group supervisory control system constituted by 4 sets of elevator cars is exemplified, 4 points 21 to 24 on the orthogonal coordinate system indicate evaluation results of the first elevator car to the fourth elevator car respectively under provisional allocation conditions. For example, assuming now that as to the second elevator car, the future call evaluation function value is "ΦF (2)" and the real call evaluation function value is "ΦR (2)" when a subject hall call is provisionally allocated thereto, an evaluation result thereof is expressed as a point 22 of a coordinate (ΦF (2), ΦR (2)). Similarly, an evaluation result of the first elevator car is expressed by a point 21; an evaluation result of the third elevator car is expressed by a point 23; and an evaluation result of the fourth elevator car is expressed by a point 24.

As indicated in FIG. 2, evaluation results obtained in the case that a newly produced hall call is allocated to the respective elevators (provisional allocation) are represented as points (coordinate points) on the orthogonal coordinates by the future call evaluation index and the real call evaluation index. As a result, such a condition that final allocation is determined by the balances of the two factors of both the future call and the real call can be visually expressed at first glance.

Next, a description is made how to determine final allocation on the orthogonal coordinates of FIG. 2.

Figure 3:
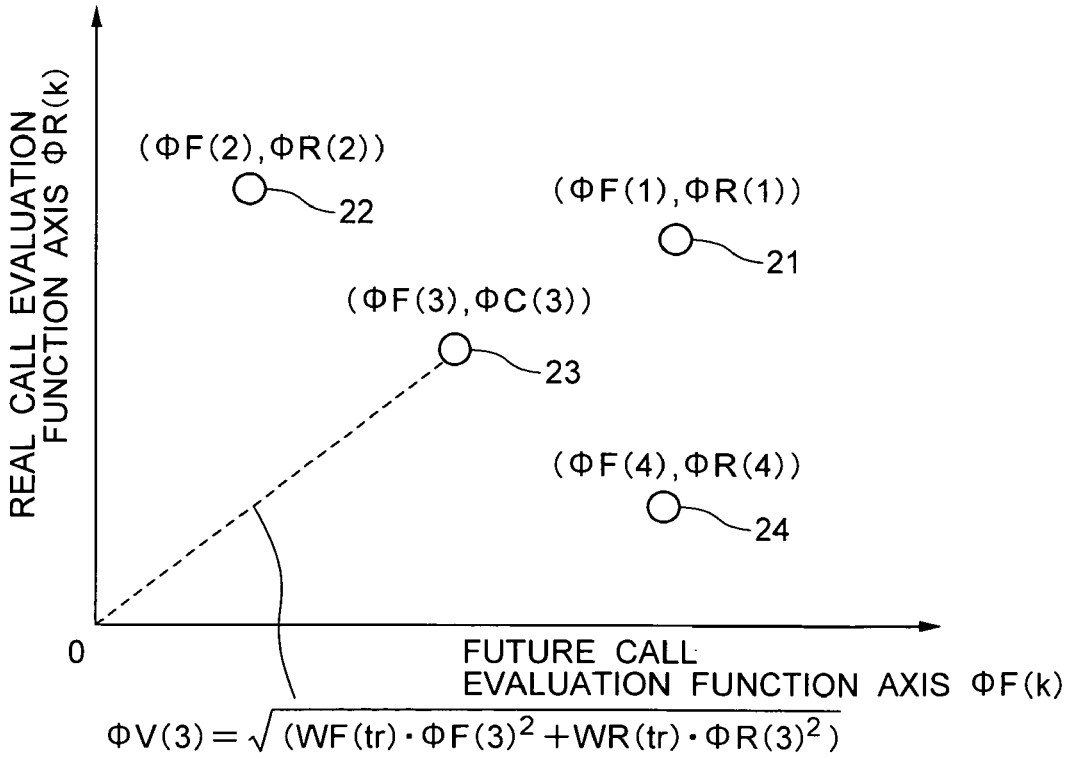
FIG. 3 is a graph for graphically representing an idea for the hall call allocating method according to the first embodiment of the present invention.

FIG. 3 is a graph for graphically showing an idea for a hall call allocating method according to the first embodiment of the present invention, namely, indicates an idea for a synthetic evaluation function which determines the final allocation. Also, this graph of FIG. 3 may directly constitute a screen which is displayed by the display unit 7. In FIG. 3, a straight line distance "ΦV (3)" between an origin "O" and a point (for example, coordinate point 23 in case of third elevator car) of an evaluation result of each of the elevators is assumed as an index of synthetic evaluation. This straight line distance is expressed by a weighted Euclidean distance as expressed by the below-mentioned expression (2):

$$\Phi V(K)=\sqrt{(WF(tr)\cdot\Phi F(K)^2+WR(tr)\cdot\Phi R(K)^2)} \quad (2)$$

In the expression (2), symbol "ΦV (K)" shows a synthetic evaluation function with respect to the K-th elevator car; symbol "WF (tr)" indicates a weighting coefficient with respect to the future call evaluation function; and symbol "WR (tr)" represents a weighting coefficient with respect to the real call evaluation function. It should also be understood that symbol "tr" shows the above-explained parameter indicative of the traffic flow condition. The weighting coefficients "WF (tr)" and "WR (tr)" become functions of the parameter "tr", respectively, and the values of these weighting coefficients are changed, depending upon the traffic flow condition. For example, since a future call is essentially firmly issued under crowded condition, such an allocation is required by taking the future call very seriously, so that it is set to WF (tr)>WR (tr). On the other hand, since possibility is low at which a future call is issued, a necessity for taking the future call very seriously is low, so that it is set to WF (tr)<WR (tr). As previously explained, the synthetic evaluation function is expressed by the weighted Euclidean distance by taking the traffic flow condition very seriously, so that such an evaluation can be realized on the orthogonal coordinate system, while the balance between the real call evaluation and the future call valuation is taken very seriously.

Figure 4:
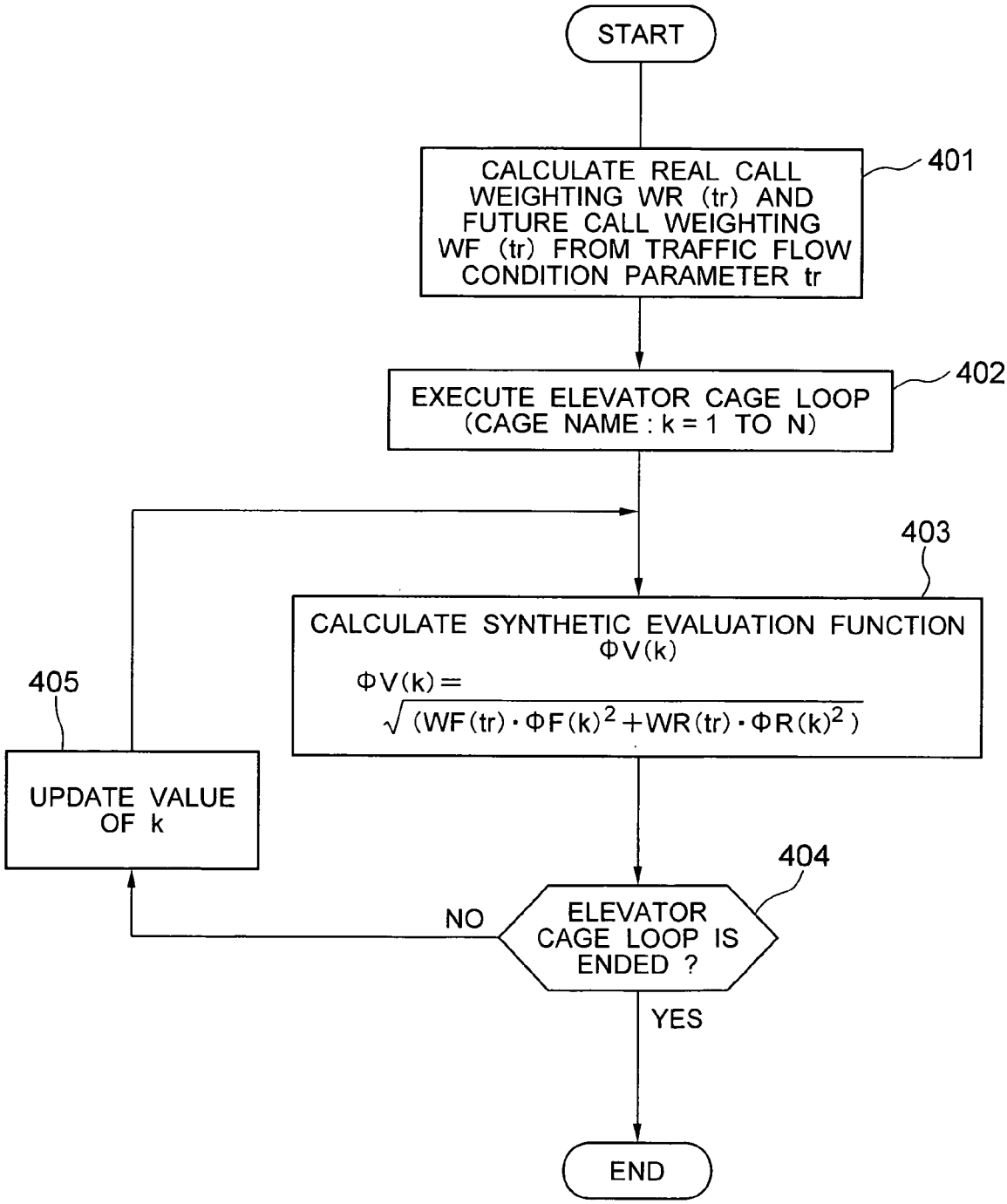
FIG. 4 is a concrete process flow chart of an allocation evaluation function calculating method according to the first embodiment of the present invention.

FIG. 4 is a flow chart for explaining concrete process operations of a synthetic evaluation function calculating method of the first embodiment. First, in a step 401, a weighting coefficient "WR (tr)" with respect to real call evaluation, and a weighting coefficient "WF (tr)" with respect to future call evaluation are calculated based upon the traffic flow condition parameter "tr". Next, in a step 402, a loop process operation using "K" indicative of a name of an elevator car is executed with respect to each of the elevators. This loop process operation will be referred to as an elevator car loop process operation hereinafter. In the elevator car loop process operation, the parameter "K" is changed from 1 to N (indicative of elevator numbers of group supervision). In a step 403, a synthetic evaluation function ΦV (K) is calculated with respect to the K-th elevator car in accordance with the above-described expression (2). In a step 404, the value of "K" is judged, and when the K-th elevator car is equal to the total car number "N", the elevator car loop process operation is ended. To the contrary, when the K-th elevator car is equal to the total car number "N", the value of "K" is updated in a step 405, and the calculation process operation of the synthetic evaluation function ΦV (K) is again repeatedly carried out in the step 403 with respect to the next K-th elevator car. Then, synthetic evaluation functions ΦV (K) are calculated with respect to the respective elevators in this manner. Such a K-th elevator car which applies the smallest ΦV (K) is determined as a finally allocated elevator.

Referring back to FIG. 2, a description is made of a method for expressing this synthetic evaluation function ΦV (K) on the orthogonal coordinates. Although the synthetic evaluation function with respect to the K-th elevator car is expressed by the above-described expression (2), this expression (2) is modified as the below-mentioned expression (3).

$$\sqrt{(WF(tr)\cdot\Phi F(K)^2+WR(tr)\cdot\Phi R(K)^2)}=C \quad (3)$$

In this expression (3), symbol "C" shows a predetermined constant (positive value). At this time, a locus of (ΦF (K), ΦR (K)) which can satisfy the above-described expression (3) constitutes such a curved line which is similar to a portion of an ellipse on the orthogonal coordinates of FIG. 1. This curved line indicates such a contour line that the value of the synthetic evaluation value "ΦV (K)" becomes the constant "C", and since the value of this constant "C" is changed, a plurality of contour lines corresponding thereto can be drawn. Based upon conditions of this contour line, conditions of the synthetic evaluation functions which are determined by combining the future call evaluation functions with the real call evaluation functions can be represented on the orthogonal coordinates. In FIG. 2, these contour line groups 25*a* to 25*g* are shown. Since such contour lines are drawn, a mechanism for allocation evaluation with respect to the respective elevators can be represented in an easy understandable manner. For instance, the contour line groups 25*a* to 25*g* of FIG. 2 are under close condition on the future call evaluation function axis (abscissa), and are under coarse condition on the real call evaluation function axis (ordinate), are brought into such a condition of WF (tr)>WR (tr), namely, the weighting coefficient becomes large with respect to the future call evaluation. As a result, the allocation is carried out by taking the future call evaluation very seriously. For instance, under the condition shown in FIG. 2, a coordinate point which is located at the innermost position with respect to the contour line groups 25*a* to 25*g* corresponds to the coordinate point 22 of the second elevator car. As a consequence, such an elevator car whose synthetic evaluation function value becomes minimum corresponds to the second elevator car, and thus, the hall call is allocated to the second elevator car. A specific attention should be paid to the coordinate point 22 of the second elevator machine. That is, when this coordinate point 22 is viewed based upon the real call evaluation function ΦR (K), the relationship is given as ΦR (4)<ΦR (3)<ΦR (2). It can be understood that the hall call can be hardly allocated to the second elevator car only by comparing the real call evaluation function values with each other. Nevertheless, the reason why the hall call is allocated to this second elevator car is given as follows: That is, the contour line groups 25*a* to 25*g* have been set by taking the future call very seriously. Although the contour lines shown in FIG. 2 indicate such a case that WF (tr)>WR (tr), the contour line groups may be alternatively drawn in response to balance conditions between real call evaluation and future call evaluation in a similar manner even in case of WF (tr)=WR (tr) and WF (tr)<WR (tr). Since the value of the weighting coefficient WF (tr) and the value of the weighting coefficient WR (tr) are changed in response to conditions of traffic flows, conditions of the contour line groups may be represented in such a manner that these conditions are changed time to time.

As previously explained, the evaluation results of the respective elevators are represented in combination with the contour lines indicative of the synthetic evaluation functions on the orthogonal coordinate system in which the future call evaluation index is indicated on the abscissa and the real call evaluation index is indicated on the ordinate. As a result, the mechanism of the allocation evaluation can be displayed in the easy understandable manner. Concretely speaking, the below-mentioned display manners are employed:

1). The evaluation results as to the respective elevators are expressed by using the points appeared on the orthogonal coordinate system in which the future call evaluation index is indicated on the abscissa and the real call evaluation index is indicated on the ordinate. As a result, the conditions of the respective elevators, which contain the balance and the like with respect to the future call evaluation and the real call evaluation, respectively, can be judged in the easy understandable manner.

2). Also, the conditions of the synthetic evaluation functions on the coordinate system are expressed as the contour lines are shown in FIG. 1. As a result, such a condition for taking both the future call evaluation and the real call evaluation very seriously, and the sequential relationship with respect to the evaluation results of the respective elevators can be represented which can be visually grasped at first glance.

It should be understood that in this first embodiment, the loci of ($\Phi F$ (K) and $\Phi R$ (K)) which can satisfy the expression (3) indicative of the synthetic evaluation function are represented as the contour lines. In this case, if the regions among the contour lines, namely the contour line zones are separately painted in accordance with different sorts of luminance, different sorts of density, or different colors, then the conditions of the synthetic evaluation function values on the coordinates can be represented in the easy understandable manner.

In the above-described first embodiment, the two evaluation indexes containing the different view points are defined as the respective coordinate axes of the two-dimensional coordinates. However, three, or more evaluation indexes which contain the different view points may be alternatively defined as the respective coordinate axes of three-dimensional, or multi-dimensional coordinates. For example, the evaluation indexes may be represented in three-dimensional bar graph (histogram) shape on the respective coordinate points 21 to 24 in FIG. 2 and FIG. 3. Also, the contour lines of the synthetic evaluation values may be expressed by coordinate axes which indicate the heights (namely, coordinate axes indicative of heights are added). As a result, the evaluation indexes may be alternatively represented which may be visually grasped as the three-dimensional graph.

Before a detailed evaluation control by the future call evaluation function calculating unit 3 shown in FIG. 1 is described, an operation image (control principle) of a target route control will now be explained with reference to FIG. 5 and FIG. 6.

Figure 5:
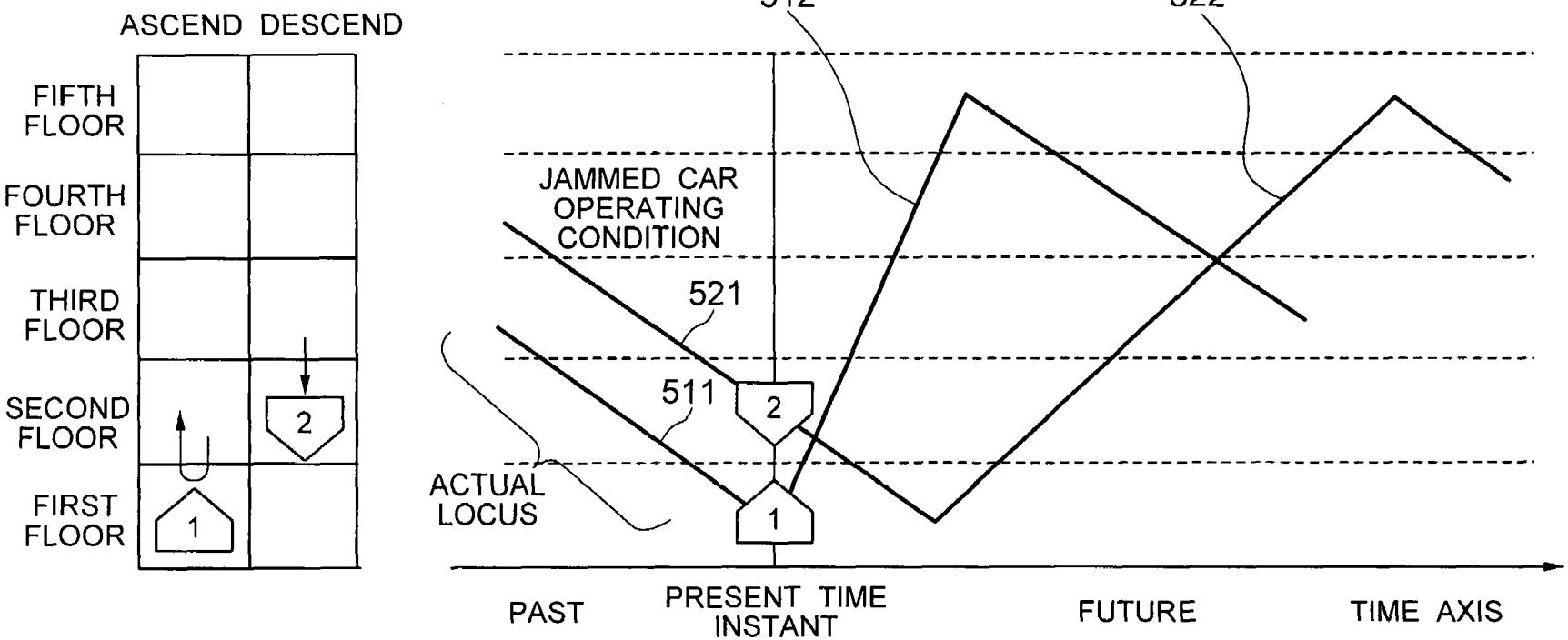
FIG. 5 is an explanatory diagram for explaining a control image (No. 1) of a target route control according to the first embodiment of the present invention.

FIG. 5 is a diagram for indicating an example of the control image of the target route control according to the first embodiment of the present invention. A left side portion of this drawing indicates an elevator path section (vertical direction) within a building, and conditions of elevator cages which are moved through this elevator path section in an image manner. In a right side portion of this drawing, while an abscissa shows time and an ordinate indicates floors of the building (heights along vertical direction of building), operating loci (operating diagram) as to the respective elevator cages on the time axis are represented, and an example of group supervision for two elevators is represented. As shown in the left side portion of the drawing, a first elevator car is operated along an ascent direction at a first floor, and a second elevator is operated along a descent direction at a second floor. When this condition is viewed on the right-sided operating diagram, as indicated as a first elevator car operating line 511 and a second elevator car operating line 521, the following condition can be seen. That is, both the first elevator car and the second elevator car were operated along the descent direction in the past, and presently, are positioned at the first floor and the second floor respectively.

A point of this first embodiment exists on target routes (operating lines) 512 and 522 which are drawn on a future time axis in the operating diagram. These target routes indicate such target loci through which the respective elevator cages should pass in future. An allocation control by a target route is featured by that an operation of each of the elevator cages is controlled in order to follow this target route, namely, allocation is controlled.

Figure 6:
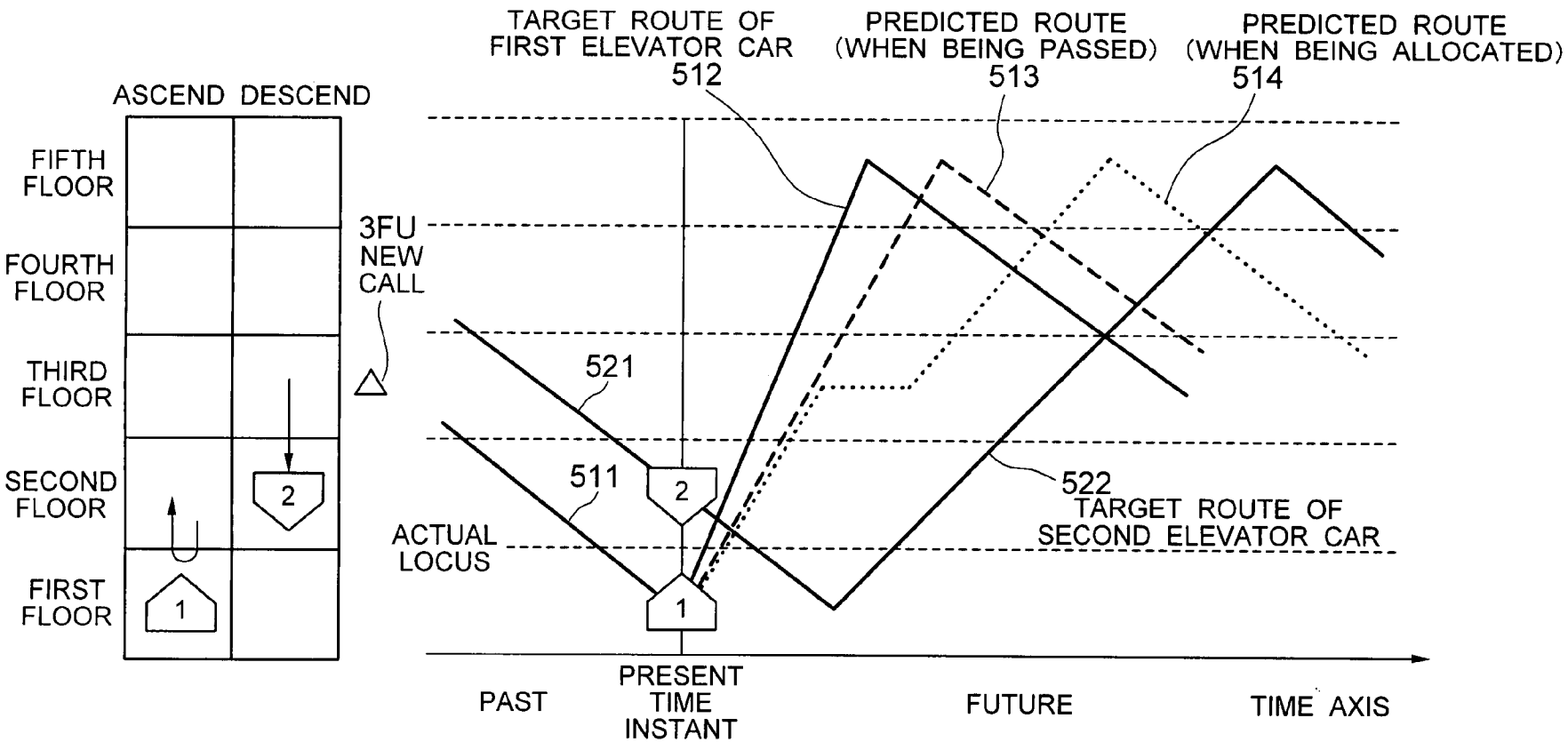
FIG. 6 is an explanatory diagram for explaining a control image (No. 2) of the target route control according to the first embodiment of the present invention.

FIG. 6 is a diagram for indicating another example of the control image of the target route control according to the first embodiment of the present invention. FIG. 6 is a diagram for representing such a condition that allocation of an elevator cage with respect to a hall call is determined in accordance with the above-described target route. First, it is so assumed that a new hall call "3FU" is produced along the ascent direction of the third floor. With respect to this hall call 3FU, an appropriate elevator car is allocated under the group supervising control. In this case, a specific attention should be paid to movement of the first elevator car. With respect to the target route 512 of the first elevator car, in the case that the new hall call is not allocated but the first elevator car passes therethrough, the predicted route thereof becomes a predicted route 513, whereas in the case that the new hall call is allocated to the first elevator car, the predicted route thereof becomes a predicted route 514. In this case, under the group supervising control of this first embodiment, operations of the respective elevator cars are moved in such a manner that these elevator car operations may follow the target route 512 and the target route 522. As a consequence, such a route which is located closer to the target route 512 corresponds to the predicted route 513, namely, a route through which the first elevator car pass without allocating the hall call, and thus, this hall call 3FU is not allocated to the first elevator car. As a result, the actual locus of the first elevator car is moved so as to follow the target route 512.

An effect of this target route control is given as follows: That is, the actual elevator cages may follow the target routes determined in such a manner that the respective elevator cars constitute the operating lines of the temporally equi-interval conditions in future. As a result, the respective elevator cages can be controlled under stable condition for a long time period in such a manner that the temporally equi-interval operating loci can be maintained.

For instance, in the case of FIG. 6, the locus 511 of the first elevator car is approached to the locus 521 of the second elevator car up to the present time, from which the following fact can be revealed. That is, the first elevator car and the second elevator car are operated under so-called "jammed car operating condition". Under this jammed car operating condition, when the hall call 3FU issued along the ascent direction at the third floor is allocated to the second elevator car, the distance between the predicted route (when allocated) 514 of the first elevator car and the predicted route 522 of the second elevator is still closed to each other, so that the "jammed car operating condition" is continued. However, when such a group supervising control is carried out that the first elevator car is separated from the second elevator car, these elevator cars are controlled along the target route 512 of the first elevator car where the loci of the respective elevator cages become the temporally equi-interval. Then, this call is not allocated to the first elevator car, but is approached to the temporally equi-interval condition along the target route.

Now, the features of the control base of the elevator group supervisory control system according to this first embodiment are classified based upon FIG. 5 and FIG. 6 as follows:

1). As indicated in FIG. 5, a target route and a locus which becomes a target on the time axis are set with respect to each of the elevator cages.

2). As indicated in FIG. 6, while the target routes are compared with the predicted routes in such a manner that the loci of the respective cages follow a target route, a hall call is allocated to such an elevator cage which is approached closer to the target.

3). Since the allocation controls are carried out based upon the above-explained bases, the operations of the respective elevator cages may follow the target route.

4). The target route is basically set in such a manner that the operating loci of the respective elevator cages become temporally equi-interval, the respective elevator cages are controlled under stable condition for a long time and are brought into the temporally equi-interval condition.

Next, a description is made of contents of the respective functional blocks of the target route control block shown in FIG. 1. In a target route forming unit 31, a target route 512 and a target route 522 as shown in FIG. 5 are formed with respect to each of the elevator cages are formed. In order to form the target routes 512 and 522, allocation hall call information, cage call information, and traffic flow information, which are acquired from the information input unit 1, are used as input data, and also, predicted route information acquired from a predicted route forming unit 32 is used as input data. Although a target route forming method will be described in detail, a more appropriate target route can be set by employing such information as to building traffic flow/elevator conditions. The predicted route forming unit 32 forms a predicted route 513 and another predicted route 514 as predicted loci which may be taken by each of the elevator cages from the present time instant. In order to form the predicted routes 513 and 514, similar input data to that in the case that the target routes are formed is utilized. In this control, a precise prediction constitutes an important point, and thus, this precise prediction may be realized by employing the detailed information as to the building traffic flow/elevator conditions, as previously explained. A detailed method for forming the predicted route will be explained later. A route evaluation function calculating unit 33 evaluates a close degree between a target route and a predicted route for every elevator based upon a route evaluation function using a route distance index. Since this route evaluation function is employed, when a hall call is allocated, it is possible to judge such an elevator cage that the predicted route is further approached close to the target route. A route distance index implies such an index that, for example, when FIG. 6 is employed as an example, close degrees between the target route 512 of the first elevator car and the predicted routes 513 and 514 are quantified. The route distance index and the route evaluation function will be explained later in detail.

Next, detailed contents of the above-described three control functional blocks 31 to 33 will now be explained.

First, a detailed process content of the target route forming unit 31, which constitutes one of the most important elements in this first embodiment, will now be described with reference to FIG. 7 to FIG. 9.

Figure 7:
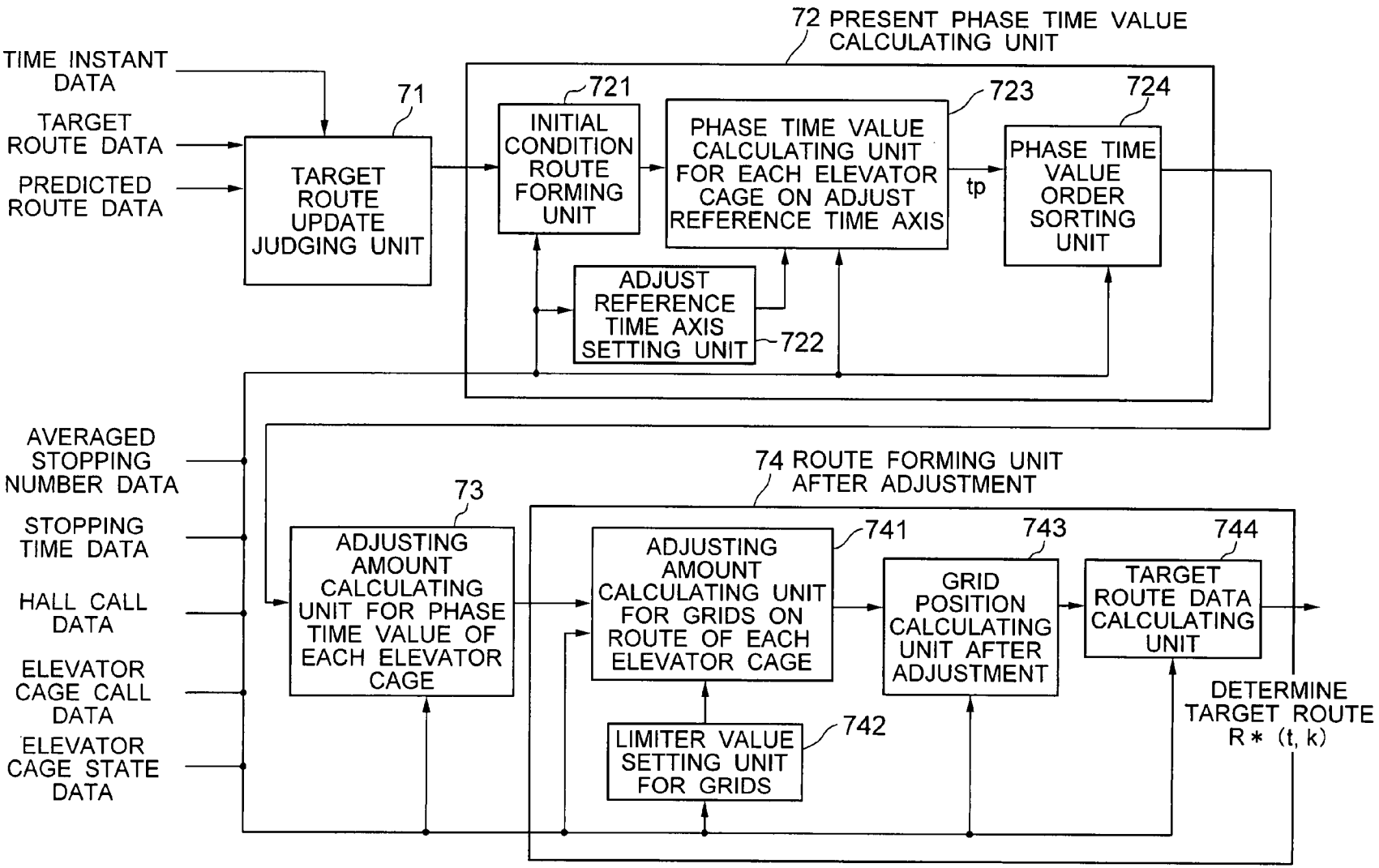
FIG. 7 is a concrete control functional block diagram of a target route forming unit according to the first embodiment of the present invention.

FIG. 7 is a concrete control functional block diagram for showing the target route forming unit 31 according to the first embodiment of the present invention. The structure of the target route forming unit 31 shown in the drawing is mainly arranged by the below-mentioned four functional blocks:

1). A target route judging unit 71,

2). a present phase time value calculating unit 72,

3). an adjusting amount calculating unit 73 for a phase time value of each elevator cage, and 4). a route forming unit 74 after adjustment.

In the beginning, as an explanation of control images, effects of the above-explained 4 functional blocks will now be explained. The target route update judging unit 71 judges as to whether or not the present target route is updated. In the case that the target route update judging unit 71 judges that the target route is updated, the present phase time value calculating unit 72 provided at the next stage evaluates an internal condition of routes of the elevator cages based upon such an index as a phase time value with respect to the predicted routes for the respective elevator cages at this time. In this connection, the reason why an idea of a "phase" is conducted is given as follows: That is, for instance, in such a case that 3-phase AC waveforms of a sine wave are considered in the electric circuit theory, such a condition that waveforms of the respective three phases are uniformed is defined based upon such a status that phases of the respective three phases are equal to each other for every $2\pi/3$ (rad). In other words, assuming now that routes of the respective elevator cages are regarded as "waveforms", if a "phase-like index" is employed with respect to a waveform, then conditions of intervals with respect to the respective routes can be easily evaluated. This "phase-like index" corresponds to an index such as the phase time value employed in this first embodiment. It should also be understood that the phase time value will be explained later. After the present phase time value calculating unit 72 calculates the phase time values at this time instant, the adjusting amount calculating unit 73 as to the phase time values of the respective elevator cages calculates a phase time value adjusting value of each of these elevator cages in order to uniform the phase time values. Based upon the calculated adjusting amounts, the route forming unit 74 after adjustment adjusts the time phase values of the original predicted routes for the respective elevator cages. The routes which are obtained based upon the adjustment results constitute a target route with respect to each of the elevator cages.

Figure 8A:
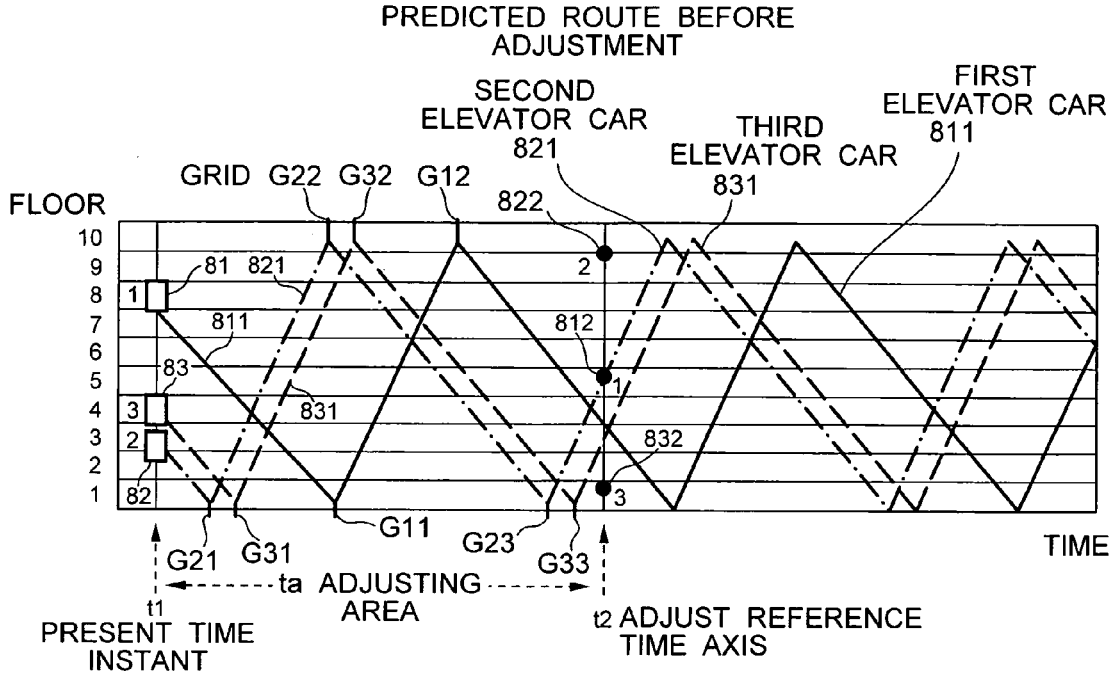
FIG. 8A indicates forming examples of target routes according to the first embodiment of the present invention.
Figure 8B:
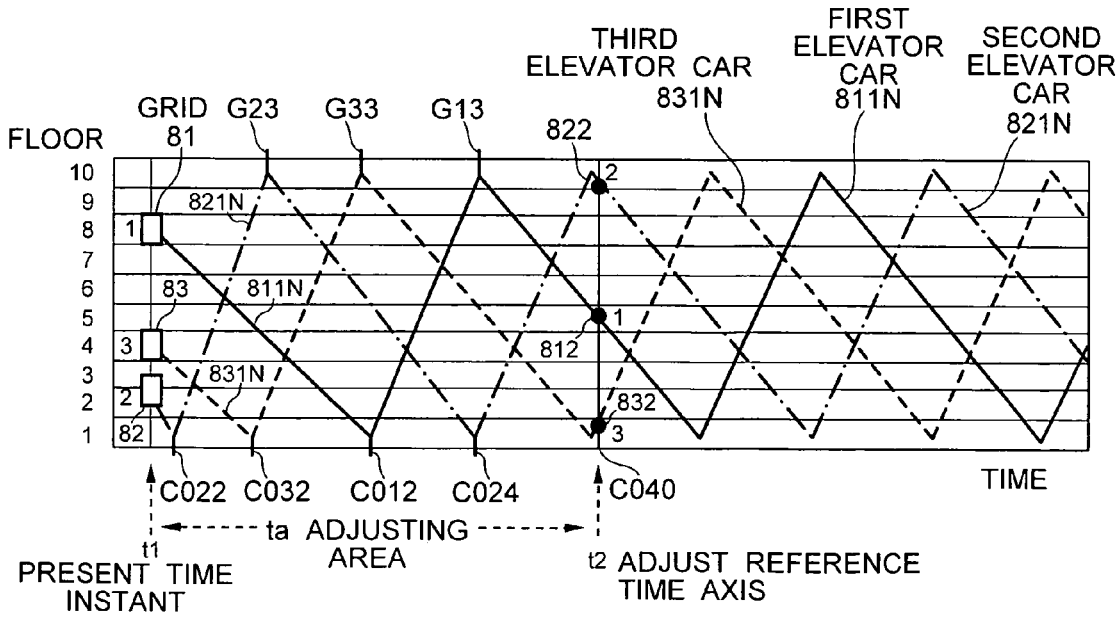
FIG. 8B indicates forming examples of target routes according to the first embodiment of the present invention.

FIG. 8A and FIG. 8B are diagrams for indicating operation images of target route forming processes which are executed by the target route forming unit 31 shown in FIG. 7. First, a description is made of operation images of control operations based upon the previously-explained summarized control content. FIG. 8A represents predicted routes before adjustments, namely, predicted routes of the respective elevator cages at the present time instant, which constitute a base for forming a target route. In this drawing, a group supervisory control system for 3 elevator cars is considered. In FIG. 8A, at the present time instant "t1", a first elevator cage 81 is under descent condition at an eighth floor; a second elevator cage 82 is under descent condition at a third floor; and a third elevator cage 83 is under descent condition at a fourth floor. As to loci of these three elevator cages 81, 82, 83, a locus of the first elevator car becomes a predicted route 811 indicated by a solid line; the second elevator car becomes a predicted route 821 indicated by a dot and dash line; and the third elevator car becomes a predicted route 831 of a broken line. It should also be noted that the predicted route forming method will be explained in an explanation of the predicted route forming unit. Apparently, the loci of these elevator cages is approached to each other, and thus, it is possible to grasp that operations of these elevator cars are substantially brought into a so-called "jammed car operating condition".

A description is returned to the control functional block arrangement of the target route forming unit 31 shown in FIG. 7. First, in such a case that the target route update judging unit 71 judges that the target route is updated, while the predicted routes 811 to 831 of the respective elevator cages of FIG. 8A are regarded as one sort of waveforms, the present phase time value calculating unit 72 calculates phase time values of the respective waveforms. This phase time value is calculated at a cross point when a predicted route of each of the elevator cages intersects an adjust reference time axis "t2" of FIG. 8A.

Next, based upon the phase time values, adjusting amounts in order that the respective predicted routes are brought into equi-interval conditions are calculated by the adjusting amount calculating unit 73 for phase time values of the respective elevator cages. The adjusting amounts are represented as target points 812 to 832 of the first to third elevator cars on an adjust reference time axis t2 in FIG. 8A. For instance, the predicted route 811 of the first elevator car is adjusted by the below-mentioned process operation in such a manner that this predicted route 811 passes through this target point 812. An execution of this adjust process operation is carried out by the route forming unit 74 after adjustment shown in FIG. 7. In this route forming unit 74, the predicted route is adjusted based upon the adjusting amount, so that a new target route is formed. As a result, loci are obtained as shown in FIG. 8B. FIG. 8B is a diagram for showing new target routes which have been formed based upon the predicted routes shown in FIG. 8A. With respect to the respective three elevator cages 81 to 83, a target route of the first elevator car 81 constitutes a solid line 813; a target route of the second elevator car 82 constitutes a dot and dash line 823; and a target route of the third elevator car 83 constitutes a broken line 833. A feature of a locus of this target route is given as follows: As shown in FIG. 8B, the routes of the respective elevator cages are drawn in order to be conducted to a temporally equi-interval condition. Concretely speaking, in FIG. 8B, in a time succeeded from the adjust reference time axis t2, the target routes of the three elevator cages are brought into temporally equi-interval conditions. Within an adjusting area between the present time instant "t1" and the adjust reference time axis "t2", a locus is drawn in order that each of these three elevator cages is conducted to a temporally equi-interval condition. The respective routes are adjusted based upon the predicted routes in such a manner that the respective routes pass through the target points 812 to 832 which are acquired by the adjusting amount, so that a target route is formed. This target route forming method will be discussed later in detail. Before explaining this target route forming method in detail, a basic idea for the target route forming method is classified with reference to FIG. 9.

Figure 9:
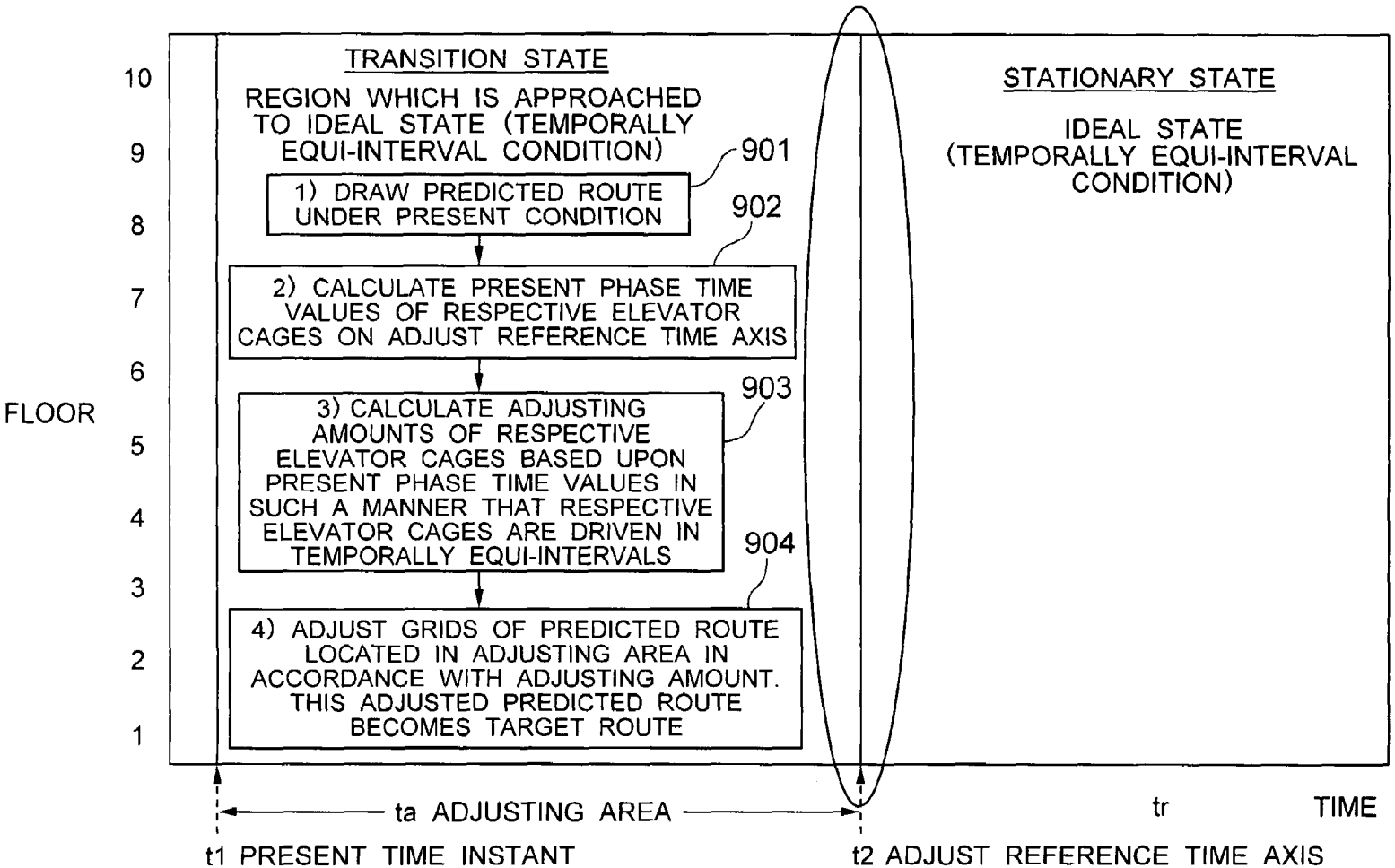
FIG. 9 is a diagram for showing a method of forming and adjusting the target route according to the first embodiment of the present invention.

FIG. 9 is a diagram for indicating a basic idea as to a method for forming and adjusting a target route, according to the first embodiment of the present invention. First, an idea for forming a target route by an adjusting area is explained. In the graph of FIG. 9, an abscissa indicates a time axis, and an ordinate indicates a position of a floor in a building. This graph is subdivided into two regions while an adjust reference time axis "t2" is defined as a boundary. The left-sided region within the two regions constitutes an adjusting area "ta". The adjusting area "ta" has been slightly explained with reference to FIG. 8B. Precisely speaking, the adjusting area "ta" corresponds to such a region which is sandwiched between the present time instant "t1" and the adjust reference time axis "t2". As indicated in FIG. 9, this region becomes a transition state, namely becomes such a region which is approached to the ideal temporally equi-interval condition. Then, an area subsequent to the adjust reference time axis "t2" becomes a stationary state "tr", namely becomes a stationary region to the ideal temporally equi-interval condition. In other words, the following idea is established, in which the transition state is formed within the adjusting area "ta" in order that the stationary state "tr" becomes the ideal state, and the transition state is conducted to the ideal state.

Also, FIG. 9 represents a control idea by an adjusting area in a target route. This control idea is constituted by the below-mentioned four processes based upon the four control functional blocks which have been explained as the outline in FIG. 7:

1). A step 901 for drawing a predicted route under present condition,

2). a step 902 for calculating present phase time values of the respective elevator cages at the adjust reference time axis "t2", 3). a step 903 for calculating adjusting amounts of the respective elevator cages, which become temporally equi-intervals, based upon the present phase time values, and 4). a step 904 for adjusting a grid of a predicted route within an adjusting area in accordance with the adjusting amounts so as to obtain a target route.

As explained above, the target route forming method which constitutes the core of this first embodiment is executed by the basic forming idea and the four basic processes explained in FIG. 9.

The basic portion and the summarized operation of the functional blocks related to the target route forming operation, the basic forming idea, and the basic processes have been so far described. Next, a detailed description is made of the target route forming operation with reference to FIG. 7, FIG. 8, FIG. 10, and FIG. 11.

First, the functional blocks contained in the target route forming unit shown in FIG. 7 will now be explained in detail. The present phase time value calculating unit 72 is arranged by an initial condition route forming unit 721, an adjust reference time axis setting unit 722, a phase time value calculating unit 723 for each elevator cage on the adjust reference axis, and a sorting unit 724 for phase time value order. In the initial condition route forming unit 721, a predicted route of each of the elevator cages at this time instant is formed, and then, the formed predicted route is set as a route under initial condition. This route under initial condition corresponds to the target route shape before adjustment, shown in FIG. 8A. In the adjust reference time axis setting unit 722, an adjust reference time axis is set. In the phase time value calculating unit 723 for each elevator cage on the adjust reference time axis, a phase time value of each elevator cage on the adjust reference time axis "t2" is calculated.

Figure 10:
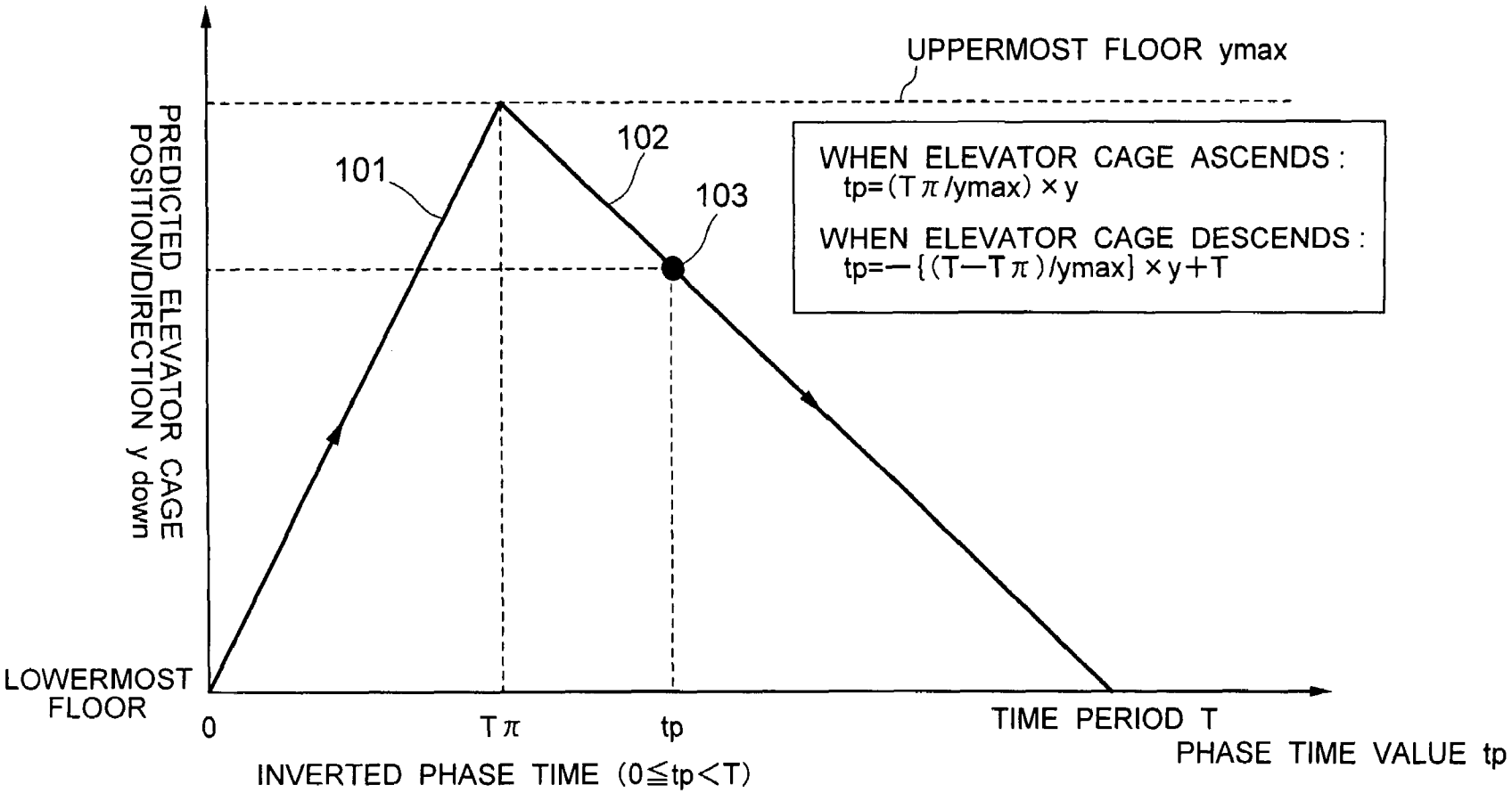
FIG. 10 is a diagram for representing a predicted route of an elevator cage according to the first embodiment of the present invention.

Now, a detailed explanation is made of phase time values with reference to FIG. 10.

FIG. 10 is a graph for indicating a predicted route of an elevator cage according to the first embodiment of the present invention. In this graph, an abscissa indicates a phase time value "tp", and an ordinate represents a floor of a building. It is so assumed that this predicted route becomes a periodic function in which a time period is "T". The following fact can be revealed. That is, for example, the predicted route 811 of the first elevator car shown in FIG. 8A corresponds to this example, and becomes the periodic function. The graph of FIG. 10 constitutes such a route that 1 time period is cut out from the predicted route for constituting this periodic function, while the lowermost floor is a starting point. This route is constituted by a route 101 when the elevator cage ascends, and another route 102 when the elevator cage descends, and corresponds to such a route that the elevator cage is circulated by 1 turn within the building. In this case, while a floor position is regarded as a phase, a phase of the lowermost floor of the elevator cage is assumed as either 0 or 2π (rad), and a phase of the uppermost floor thereof is assumed as π (rad). Also, while phases of the elevator cage are similarly considered as a sine wave, an ascending operation of the elevator cage is assumed as phases 0 to π of a positive polarity, whereas a descending operation of the elevator cage is assumed as phases π to 2π. At a time point (time point "Tπ") of the phase π, since the phase is inverted from a positive phase to a negative phase, this time point is named as an inverted phase time "Tπ". Also, the position of the uppermost floor is expressed as "ymax". Under the above-explained setting condition, a phase time value "tp (0≦tp<T)" of the elevator cage on the predicted route is defined as the below-mentioned expressions (4) and (5):

$$tp=(T\pi/y\max)Xy \text{ (ascending operation of elevator cage: } 0\leqq tp<T\pi) \quad (4)$$

$$tp=-\{(T-T\pi)/y\max\}Xy+T \text{ (descending operation of elevator cage: } T\pi\leqq tp<T) \quad (5)$$

In the expressions, symbol "y" indicates an amount which represents a predicted position of an elevator cage which is required is expressed as a position on the floor axis. For instance, a phase time value "tp" with respect to a predicted position 103 of the elevator cage can be calculated by tp=(Tπ/ymax)Xy based upon the above expression (4) on the predicted route shown in FIG. 10. A merit of the phase time value "tp" is given as follows: That is, since a phase amount is a value which has been rearranged in a temporal dimension, a phase amount at an arbitrary time point of each route can be exclusively evaluated based upon a phase time value. As a consequence, a degree of temporally equi-interval conditions of each of the elevator cages can be easily evaluated by employing such a phase time value.

Again, the description is returned to FIG. 7. In the phase time value calculating unit 723 for each elevator cage on the adjust reference time axis within the present phase time value calculating unit 72, a phase time value is calculated with respect to a cross point between a predicted route of each elevator cage and the adjust reference time axis "t2", by using the expression (4) or the expression (5).

Figure 11A:
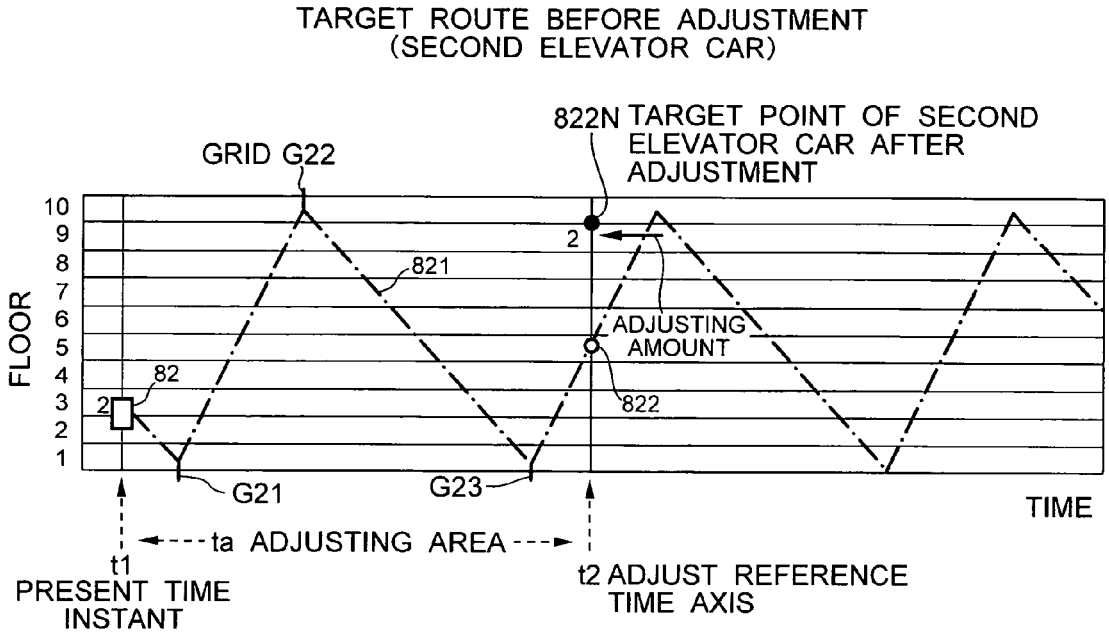
FIG. 11A is a diagram for representing controlling ideas of the target route forming unit according to the first embodiment of the present invention.
Figure 11B:
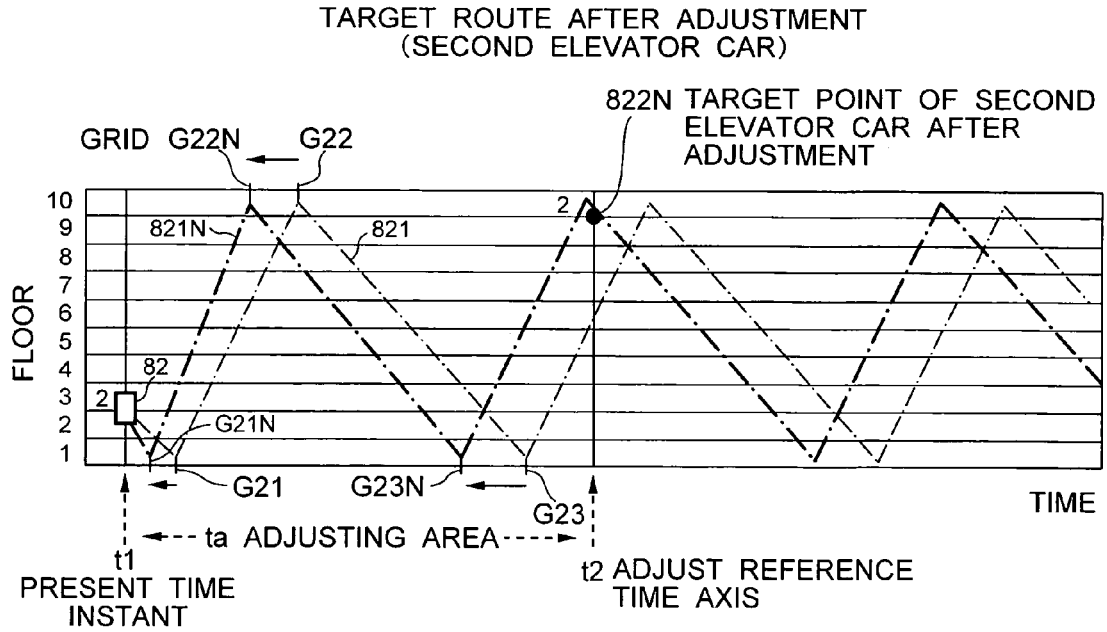
FIG. 11B is a diagram for representing controlling ideas of the target route forming unit according to the first embodiment of the present invention.

FIG. 11A and FIG. 11B are diagrams for indicating an idea of the target route forming unit 31 according to the first embodiment of the present invention. For the sake of easy understanding, these drawings indicate that only one elevator cage (namely, second elevator car) is derived. FIG. 11 A shows a predicted route as a target route shape before being adjusted. This predicted route is formed by the initial condition route forming unit 721 of FIG. 7. The adjust reference time axis t2 of FIG. 11A is set by the adjust reference time axis setting unit 722 of FIG. 7. A phase time value "tp" of the predicted route 821 of the second elevator car 111 on this adjust reference time axis t2 is calculated by the phase time value calculating unit 723 for each elevator cage on the adjust reference time axis "t2". In other words, this phase time value calculating unit 723 calculates such a phase time value "tp" at a cross point 822 between the predicted route 821 of the second elevator car 82 and the adjust reference time axis t2. For instance, in the case of the cross point 822 of FIG. 11A, the elevator car is under ascending operation condition, namely is located from 0 (rad) to π (rad) in the phase. As a result, a phase time value "tp" can be calculated from a predicted elevator cage position "y" in accordance with the expression (4). In this case, a time period "T" may be calculated from various data as to a floor number of the building, a floor width, a rated speed of an elevator cage, an averaged stop number and stopping time, which are determined by a traffic flow condition of the building at this time point. Similarly, an inverted phase time "Tπ" may be calculated from the above-explained data. Also, a floor position "ymax" of the uppermost floor corresponds to a constant which is determined by a building.

Returning back to FIG. 7, phase time values of the respective elevator cages are calculated in the above-explained manner by the phase time value calculating unit 723 for each elevator cage on the adjust reference time axis t2. Thereafter, the phase time values with respect to the respective elevator cages are sorted in the order of the phase time values by the sorting unit 724 for phase time order. This order will be referred to as a "phase order" hereinafter. As previously explained in FIG. 10, the phase time value "tp" of each of the elevator cages is defined on the waveform of 1 circle. The further a phase time value is temporally located on the waveform of FIG. 10, the larger a phase time value becomes. On the other hand, the phase time value "tp" has been adjusted in such a manner that this phase time value "tp" is located in such a range of 0≦tp (K)<T. For example, when three sets of elevator cage conditions in the target route shapes before being adjusted of FIG. 8A are exemplified, the phase time values of the respective elevator cages are defined in the phase order of the third elevator car, the second elevator car, and the first elevator car (namely, from smaller phase time value) due to the cross points between the adjust reference axis "t2" and the predicted route of each of the elevator cages. The sorting unit 724 for phase time value order acquires such a phase order by employing a sorting algorithm, for example, a direct selecting method, a bubble sort, and the like. In the adjusting amount calculating unit 73 for phase time value of each elevator cage, intervals of the respective elevator cages are calculated by way of phase time values based upon the calculated phase time values of the respective elevator cages and the phase order thereof, and the calculated phase time values are compared with a reference value in order to become an equi-interval, and then, adjusting amounts of the phase time values of the respective elevator cages are calculated which are expressed as differences of the comparisons. That is, in this example, the following idea is used, i.e., intervals (evaluated by phase time value) of the respective elevator cages are calculated from the predicted routes, the calculated intervals are compared with the reference value used to become the equi-interval, and then, the differences of these comparisons are employed as the adjusting amounts used to adjust the phase time values.

While the predicted route of FIG. 8A is exemplified, contents of the process operations by the adjusting amount calculating unit 73 for phase time value of each elevator cage will now be explained. As previously explained, in FIG. 8A, the phase orders of the phase time values as to the predicted routes 811 to 831 of the respective elevator cages on the adjust reference time axis "t2" are defined in this order of the third elevator car, the second elevator car, and the first elevator car. Assuming now that 1 periodic time of a predicted route is "T", a phase time value "tp (K)" of a k-th elevator car is defined in such a manner that a phase time value of the third elevator car is defined as tp (3)=0.09T; a phase time value of the second elevator car is defined as tp (2)=0.17T; and a phase time value of the first elevator car is defined as tp (1)=0.77T. When intervals of the respective elevator cages are calculated in the phase order, an interval between the second elevator car and the third elevator car is calculated as tp (2)−tp (3) =0.08T; an interval between the first elevator car and the second elevator car is calculated as tp (1)−tp (2)=0.6T; and an interval between the third elevator car and the first elevator car is calculated as tp (3) −tp (1)+T=0.32T. Since the intervals of the respective elevator cages are quantified based upon the phase time values in the above-described manner, the intervals of the respective elevator cages can be evaluated in the quantitative manner. It is possible to grasp that, for example, the interval between the second elevator car and the third elevator car is very narrow due to the above-explained result. Since 1 periodic time is set as "T" in the phase time value, in the cave that "N" cars of elevators are group-supervised, an interval of the respective elevator cars under temporally equi-interval condition which constitutes the target interval may be expressed by T/N. In the example of FIG. 8A, since the three elevator cars are group-supervised, an interval among these three elevator cars which constitute the target interval may be expressed by T/3=0.33T.

Differences between this interval which constitutes the target interval and the present intervals of the respective elevator cages become such intervals which should be adjusted. For instance, an interval +0.25T (=0.33T−0.08T) becomes the interval value which should be adjusted between the second elevator car and the third elevator car; another interval −0.27T (=0.33T−0.6T) becomes the interval value which should be adjusted between the first elevator car and the second elevator car; and another interval +0.01T (=0.33T−0.32T) becomes the interval value which should be adjusted between the third elevator car and the first elevator car. In the above intervals, a positive symbol (+) implies that an interval must be widened, and a negative symbol (−) implies that an interval must be narrowed. Based upon these interval values which should be adjusted, adjusting amounts of phase time values with respect to the respective elevator cages are calculated. These adjusting amounts may be calculated based upon the following algorithm. For example, as the three elevator cage group supervision, it is so assumed that an A-th elevator car, a B-th elevator car, and a C-th elevator car are arrayed in this phase order. For the sake of a general expression, names of elevator cars are expressed by employing alphabetical symbols. In accordance with the above-explained assumption, such a relationship of 0≦tp (A)≦tp (B)≦tp (C)<T may be established. In this case, an adjusting amount of a phase time value with respect to each elevator cage is expressed as "Δtp (K)". First, in order that the intervals of the respective elevator cages can satisfy the target interval of T/3, the below-mentioned expressions must be established.

$$(tp(B)+\Delta tp(B))-(tp(A)+\Delta tp(A))=T/3 \quad (6)$$

$$(tp(C)+\Delta tp(C))-(tp(B)+\Delta tp(B))=T/3 \quad (7)$$

$$(tp(A)+\Delta tp(A))-(tp(C)+\Delta tp(C))+T=T/3 \quad (8)$$

For example, as to the expression (6), the phase time value after being adjusted is expressed by "tp (B)+Δtp (B)" with respect to the present phase time value "tp (B)". As a consequence, this expression (6) indicates such a difference between the phase time value of the B-th elevator car after being adjusted and the phase time value of the A-th elevator car after being adjusted, namely indicates that the interval can satisfy T/3. In this case, since the above-described three equations are not mutually independent from each other, only these three equations cannot be solved as to "Δtp (A)", "Δtp (B)", and "Δtp (C)". As a consequence, as another condition, such a condition is added in which gravity on an arrangement as viewed by the phase time value of the present each elevator cage is coincident with gravity on an arrangement as viewed by the phase time value of he each elevator cage after adjustment. This added condition is given as the below-mentioned expression (9):

$$(tp(A)+tp(B)+tp(C))/3=\{(tp(A)+\Delta tp(A))+(tp(B)+\Delta tp(B))+(tp(C)+\Delta tp(C))\}/3 \quad (9).$$

When the above-described expression (9) is rearranged, the below-mentioned expression (10) is given:

$$\Delta tp(A)+\Delta tp(B)+\Delta tp(C)=0 \quad (10)$$

When the above-explained expression (6), (7), (8), and (10) are solved as to Δtp (A), Δtp (B), and Δtp (C), the below-mentioned expressions (11) to (13) are given:

$$\Delta tp(A)=(-2/3)tp(A)+(1/3)tp(B)+(1/3)tp(C)+(-1/3)T \quad (11)$$

$$\Delta tp(B)=(1/3)tp(A)+(-2/3)tp(B)+(1/3)tp(C) \quad (12)$$

$$\Delta tp(C)=(1/3)tp(A)+(1/3)tp(B)+(-2/3)tp(C)+(1/3)T \quad (13)$$

In this case, adjusting amounts are collected with respect to three elevator cars, namely, the A-th elevator car, the B-th elevator car, and the C-th elevator car, in which the phase time values before being adjusted become 0≦tp (A)≦tp (B)≦tp (C)<T. In other words, the adjusting amounts "Δtp (A)", "Δtp (B)", and "Δtp (C)" can be obtained by the respective expressions (11) to (13), while these adjusting amounts can satisfy such a condition that the respective elevator cages are brought into temporally equi-interval conditions after the adjustment, and further, the arrangements of the three elevator cars are not changed before and after the adjustment. For example, when the example of FIG. 8A is exemplified, the A-th, B-th, and C-th elevator cars correspond to the third, second, and first elevator cars, respectively. As a result, the phase time values are given as follows: tp (A)=tp (3)=0.09T, tp (B)=tp (2)=0.17T, and tp (C)=tp (1)=0.77T. The adjusting amounts with respect to the respective elevator cages are calculated based upon the expressions (11) to (13) as follows: Δtp (A)=Δtp (3)=−0.081T, Δtp (B)=Δtp (2)=0.177T, and Δtp (C)=−0.096T. For the sake of confirmation, phase time values after being adjusted are obtained, respectively. That is, these phase time values are obtained as follows: tp (A)+Δtp (A)=tp (3)+Δtp (3)=0.010T, tp (B)+Δtp (B)=tp (2)+Δtp (2)=0.343T, and tp (C)+Δtp (C)=tp (1)+Δtp (1)=0.677T. As a consequence, all of the intervals of the respective elevator cages become equal to 0.33T, and thus, can satisfy the equi-interval condition.

Next, returning back to FIG. 7, a detailed description is made of process operations for forming routes after adjustments by the route forming unit 74 for adjustment by employing the adjusting amounts which are calculated by the adjusting amount calculating unit 73 for phase time values of the respective elevator cages. In the route forming unit 74 after adjustment, first of all, a calculation is made of an adjusting amount of a grid on a target route before each of the elevator cages is adjusted by a grid adjusting amount calculating unit 741 for a grid on a route of each elevator cage. In the beginning, such a grid is explained with reference to FIG. 11A. As previously explained, FIG. 11A indicates, while only the second elevator car is derived, the target route before being adjusted. This grid is defined as a direction inverting point of a route which constitutes a subject route within an adjusting area. In FIG. 11A, three direction inverting points of the target route 112 before being adjusted constitute a grid "G1" to a grid "G3", respectively. Since the position of this grid is adjusted along a horizontal direction, the phase time value of the subject route can be adjusted. The adjusting amounts of the respective grids are determined by employing such a method that while adjusting amounts of the relevant elevator cage are defined as a total adjusting amount, the adjusting amounts are sequentially allocated from a grid located near the present time to the respective grids until the allocated adjusting amounts exceed limiter values which are set to the relevant grids. In this case, the limiter values of the adjusting amounts of the respective grids are set by a limiter value setting unit 742 for grid.

The above-explained method will now be explained by exemplifying the case of FIG. 11A. First, it is so assumed that grid adjusting amounts with respect to the 3 grids G1 to G3 of the second elevator car are "Δgtp (k=2, i=1, 2, 3)". In this case, symbol "k" shows an elevator car number, and symbol "i" indicates a grid number. The grid numbers "i" are sequentially numbered from smaller numbers from the present time to the future direction. Also, it is so assumed that limiter values with respect to the adjusting amounts of the respective grids are defined as "LΔgtp (k=2, i=1, 2, 3)". As previously calculated, the adjusting amount of the phase time value of the second elevator car corresponds to tp (2)+Δtp (2)=0.343T. This adjusting amount is allocated to Δgtp (k=2, i=1), Δgtp (k=2, i=1), and Δgtp (k=2, i=3), respectively, in order that this adjusting amount becomes smaller than, or equal to the limiter value. For instance, assuming now that the limiter values of the respective grids are defined as LΔgtp (k=2, i=1)=0.2T, LΔgtp (k=2, i=2) 0.2T, and LΔgtp (k=2, i=3)=0.1T, an adjusting amount of the first grid becomes Δgtp (k=2, i=1)=0.2T (=LΔgtp (k=2, i=1); being fixed to limiter value). Also, a total amount of the remaining phase time adjusting amounts becomes 0.343T−0.2T=0.143T. Next, an adjusting amount of the second grid becomes Δgtp (k=2, i=2)=0.143T. Since a total amount of the remaining phase time amounts becomes zero, an adjusting amount of the third grid becomes Δgtp (k=2, i=2)=0.

Returning back to FIG. 7, in the grid position calculating unit 743 after adjustment, a grid position "gpN (k, i)" after adjustment is calculated based upon an adjusting amount (Δgtp (k, i)) with respect to each of the grids, and a position "gp (k, i)" of this grid before adjustment. For example, in the case that a total number of the grids is 3 (i=1, 2, 3) in k=second elevator car, calculation formulae of the respective grids are given as follows:

$$gpN(k=2, i=1)=gp(k=2, i=1)+\Delta gtp(k=2, i=1) \quad (14)$$

$$gpN(k=2, i=2)=gp(k=2, i=2)+\Delta gtp(k=2, i=1)+\Delta gtp(k=2, i=2) \quad (15)$$

$$gpN(k=2, i=3)=gp(k=2, i=3)+\Delta gtp(k=2, i=1)+\Delta gtp(k=2, i=2)+\Delta gtp(k=2, i=3) \quad (16)$$

Since an adjusting amount of a gird is succeeded to the subsequent grid, a position at the final grid is adjusted by such a total amount of phase time value adjusting amounts with respect to this final grid.

With respect to the adjusted positions of the respective grids in the above-explained manner, these adjusted positions are coupled to each other, so that a new target route can be formed. In the target route data calculating unit 744, data of this new target route is calculated to be updated. A target route 821N after being adjusted which is drawn by a bold line of FIG. 11B has been formed based upon a predicted route 821 after being adjusted in FIG. 11B. In the grid position calculating unit 743 after adjustment, positions of grids after being adjusted are calculated, and a grid G21 is shifted to another grid G21N after being adjusted. Similarly, a grid G22 is shifted to another grid G22N, and a grid G23 is shifted to another grid G23N. When these three grids G21N, G22N, G23N are coupled to each other, a route 821N indicated by a dot and dash line drawn by a bold line can be drawn, and thus, this route 821N constitutes such a target route which is newly updated. As apparent from FIG. 11B, the newly updated target route 821N passes through a target point 822N after being adjusted which has been set to the adjusting amount of the phase time value. As previously explained, the routes of the respective elevator cages are adjusted in each a manner that these routes pass through the target points after being adjusted. As a result, the result obtained by combining the three elevator cages is indicated in FIG. 8B, from which the following condition can be grasped. That is, after the adjust reference time axis "t2", the target routes 811N to 831N of the three elevator cars are brought into temporally equi-interval conditions. Apparently, the respective target routes 811N to 831N pass through the respective target points after being adjusted. Also, the following condition can be grasped. That is, the target routes within the adjusting area which has been adjusted by the grids play a role of a transition guiding function in order that these target routes become the temporally equi-interval condition after the adjust reference time axis "t2".

Figure 12:
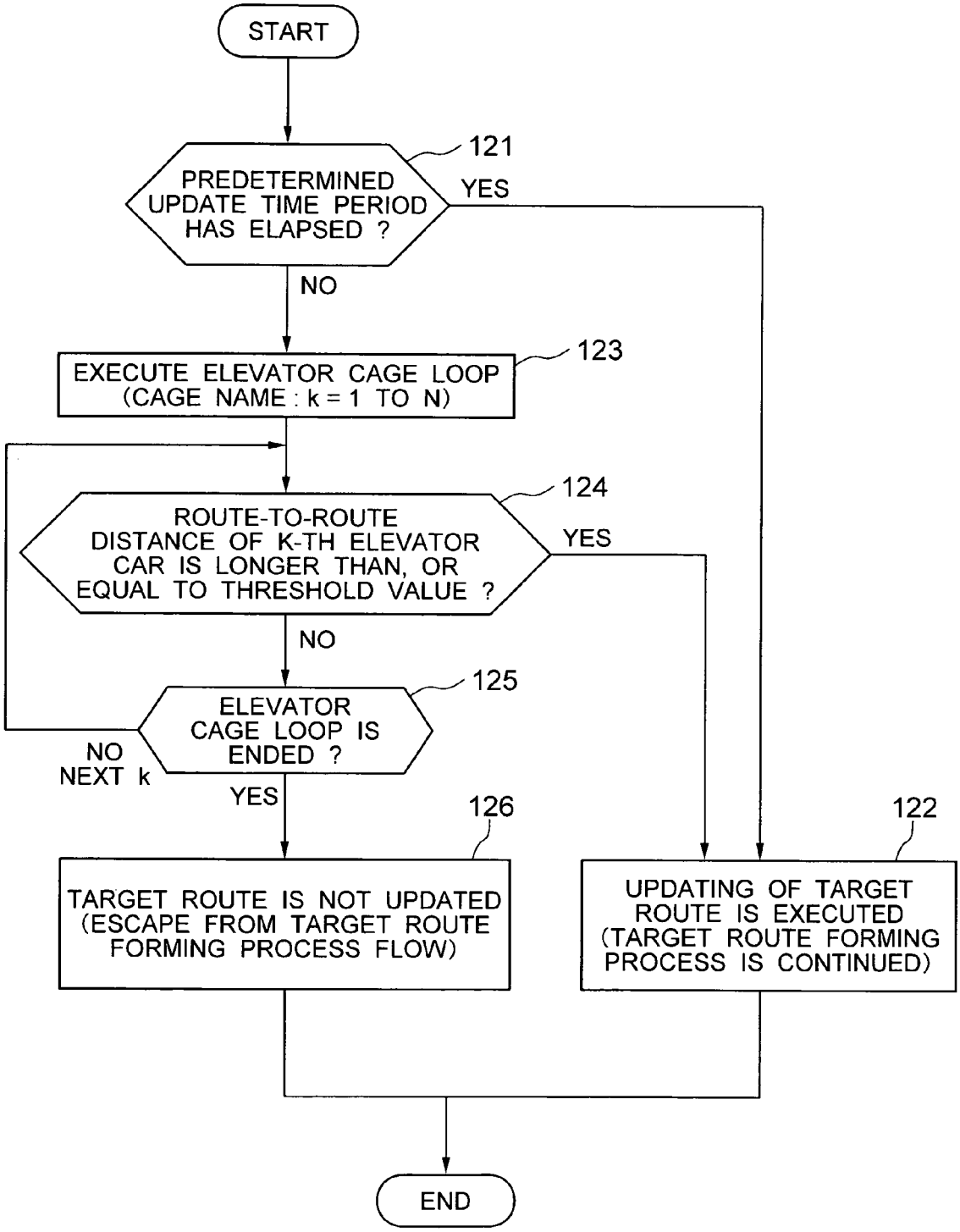
FIG. 12 is a flow chart for explaining a target route update judging process operation according to the first embodiment of the present invention.

FIG. 12 is a flow chart for explaining process operations of a target route updating operation according to the first embodiment of the present invention. In order to update a target route, three major ideas are given:

1). A method for updating a target route in a periodic manner in a predetermined time period;

2). another method for detecting a distance between a target route of a certain elevator cage and a predicted route thereof (in this method, distance will be referred to as a "route-to-route distance"), and for updating the target route in the case that while this route-to-route distance exceeds a predetermined value, the target route is separated from the predicted route; and 3). another method made by combining the above-described method 1) with the method 2).

The process operation of FIG. 12 corresponds to the above-described method 3). The methods 1) and 2) may be carried out if the method 3) is partially utilized. First, in a step 121, a check is made as to whether or not a predetermined update time period has elapsed by checking either a clock or a timer. When the predetermined update time period has elapsed, an updating process operation of the target route is carried out in a step 122. This updating process operation corresponds to the process operations subsequent to the target route update judging unit 71 of FIG. 7. When the predetermined update time period has not yet elapsed, the process operation is advanced to a step 123. In this step 123, a loop process operation is carried out in an elevator cage loop so as to calculate a distance (route-to-route distance) between a target route and a predicted route with respect to each of the elevator cages. Next, in a step 124, a judgement is made as to whether or not this calculated distance is larger than, or a predetermined threshold value. The distance (route-to-route distance) between the target route and the predicted route corresponds to an index which indicates how far the target route is separated from the predicted route. This index will be explained in detail with reference to FIG. 14. The idea of this process operation is made by such an idea that when an estrangement between a target route and a predicted route is large and the target route must be corrected, this estrangement is judged based upon a threshold value. As to the respective elevator cages, when a route-to-route distance of even one elevator cage is larger than, or equal to the threshold value, an update process operation of the target route is carried out at a step 122. In such a case that all of the route-to-route distances are smaller than the threshold value with respect to all of the elevator cages, and further, completions of checking the route-to-route distances as to all of the elevator cages can be confirmed at a step 125, the process operation is advanced to a step 126. In this step 126, the present target route is directly employed without updating the target route.

In order to update a target route, the following two ideas can be conceived, namely, a first idea (flexible target route) by which the target route is properly corrected so as to continuously maintain a proper target route; and a second idea (fixed target route) by which the once decided target route is not changed for the time being, and this decided target route is maintained as long as possible. Since the first and second ideas own merits as well as demerits, two control parameters such as the update time period and the threshold value of the route-to-route distance, which have been explained with reference to FIG. 12, are properly set.

The target route forming method has been explained which constitutes the core in the elevator group supervision for controlling on the target route, according to this first embodiment. Next, a description is made of a method for forming a predicted route which constitutes an index for causing an actual locus of an elevator cage to follow a target route.

The method of forming the predicted route will now be explained with reference to FIG. 13.

Figure 13:
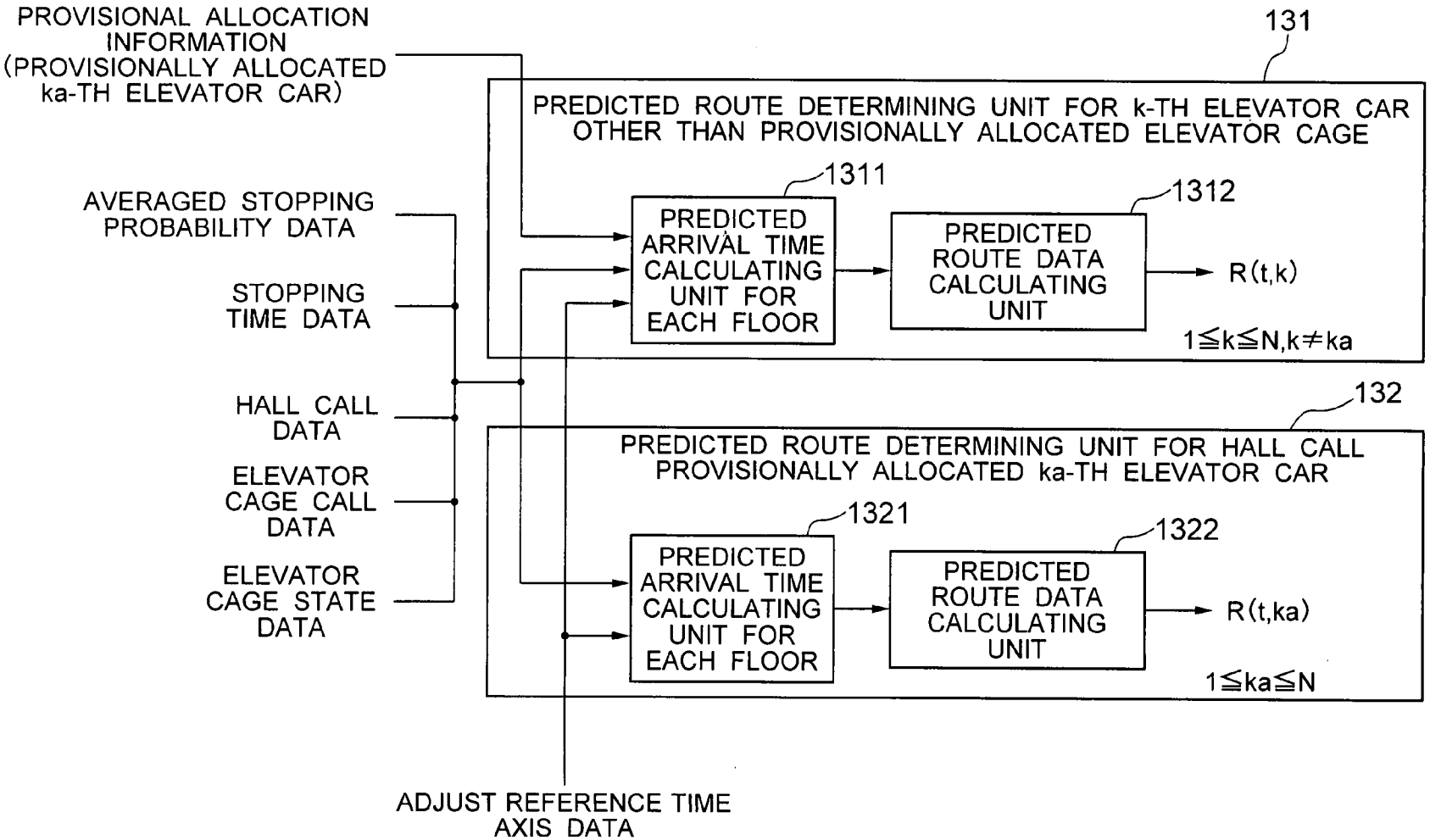
FIG. 13 is a control functional block diagram of a predicted route forming unit according to the first embodiment of the present invention.

FIG. 13 is a control functional block diagram of a predicted route forming unit according to the first embodiment of the present invention. The predicted route forming unit is equipped with a predicted route determining unit 131 and another predicted route determining unit 132, which are subdivided into two systems of elevators (k-th elevator car: $1 \leqq k \leqq N$, "k" is not equal to "ka") other than provisionally allocated elevators with respect to a hall call, and of provisionally allocated elevators (ka-th elevator car: $1 \leqq ka \leqq N$) when a predicted route is formed. A description is firstly made of the predicted route determining unit 131 with respect to the elevators (k-th elevator car) other than the provisionally allocated elevators.

First, in an arrival prediction time calculating unit 1311 for every floor, averaged stopping number data and stopping time data are calculated, which are determined by a traffic flow condition at a present time. Also, in this arrival prediction time calculating unit 1311, an arrival prediction time for every floor is calculated with respect to each of the elevator cages by employing data of a hall call allocated to each of the elevator cages, data of a cage call produced in each of the elevator cages, cage condition data, and the like. For example, as a simple example, such a case is considered. That is, the relevant elevator cage is stopped at a first floor in a building constructed of 4 floors along an ascending direction. In this case, a transport time for 1 floor is simply determined as 2 seconds, and a stopping time when the elevator cage is stopped is uniformly determined as 10 seconds. Also, it is so assumed that an ascending hall case of the second floor has been allocated to this elevator cage, and a cage call destined to 4-th floor has been issued by a passenger who got into the elevator cage at the first floor. A traffic flow condition at this time is assumed as a traffic flow condition during normal time during which floor-to-floor transport is relatively large. Also, averaged stopping probability at each floor and each direction where a call is not issued is assumed to become uniform, namely 0.25. It should be understood that the averaged stopping probability in this case represents such an averaged stopping probability with respect to each floor in the case that the elevator cage is circulated by 1 turn within the building. Under the above-explained conditions, when arrival prediction times for the respective floors as to the relevant elevator cage are calculated, the following calculation results are given: The second floor (ascent): 2 seconds, the third floor (ascent): 14 seconds, the fourth floor (ascent): 18.5 seconds, the fifth floor (inverted): 30.5 seconds, the fourth floor (descent): 35 seconds, the third floor (descent): 39.5 seconds, the second floor (descent): 44 seconds, and the first floor (inverted): 48.5 seconds. Next, in a predicted route data calculating unit 1312, the relationship as to these arrival prediction times for the respective floors is considered in a reverse sense, and thus, this relationship is considered as predicted positions of the elevator cage with respect to future times. As a consequence, while such a coordinate system is conducted in which a time axis is defined as an abscissa and a position of a floor is defined as an ordinate, points determined by times and predicted positions are connected to each other, so that a predicted route in the future can be formed. For example, which such a condition of ("t" seconds, "y-th" floor) is given on the coordinate system where the time axis is defined as the abscissa and the position of the floor is defined as the ordinate, points of (0, 1), (2, 2), (14, 3), (18.5, 4), (30.5, 5), (35, 4), (39.5, 3), (44, 2), and (48.5, 1) can be plotted. When these points are connected to each other, a predicted route can be formed. Although a stopping time is omitted in this example, a predicted route involving the stopping time may be alternatively drawn. In this alternative case, a point when a stopping operation is ended may be newly added. If the stopping times are involved, then a shape of a predicted route may be made more correctly.

When the above-explained sequential operations are again classified, the arrival prediction time for every floor is considered as the predicted position of the elevator cage with respect to the future time, and is mapped on the point on the coordinate axes where the abscissa indicates the time axis and the ordinate indicates the floor position. Then, since the respective points are connected to each other as the line, the predicted route can be formed. At this time, the predicted route may be considered as such a function on the coordinate axes where the abscissa indicates the time axis and the ordinate indicates the floor position. Assuming now that a time is "t", a floor position is "y", and a number of an elevator cage is "k" ($1 \leqq k \leqq N$: symbol "N" is total number of elevator cage), the predicted route may be expressed as $y=R(t, k)$.

Next, a description is made of the predicted route determining unit 132 with respect to the provisionally allocated elevator (ka-th elevator car). In this case, there is such a technical different point that a predicted route to which provisional allocation is reflected is formed with respect to the provisionally allocated elevator cage "ka". Concretely speaking, in addition to provisionally allocation information with respect to a new hall call, an arrival prediction time for every floor is calculated by an arrival predicted time calculating unit 1321 for every floor. Next, in a predicted route data calculating unit 1322, predicted route data is calculated. The predicted route to which the provisional allocation obtained in the above-described manner has been reflected can be expressed as a function "R (t, ka)" on a coordinate system of a time-to-floor position.

Next, a description is made of a route evaluation function which constitutes such an index when a route-to-route distance and allocation are determined. This route-to-route distance constitutes a close degree between a target route and a predicted route. In the presently available system, an allocation evaluation function for evaluating allocation in a quantitative manner is defined as a function of a predicted waiting time with respect to each call. In the control system of this first embodiment, the "allocation evaluation function" is not defined by the predicted waiting time, but by an amount (route-to-route distance) which indicates a close degree between a target route and a predicted route, which constitutes a major feature of the present invention.

First, the route-to-route distance corresponding to the index which expresses the close degree between the target route and the predicted route will now be explained with reference to FIG. 14.

Figure 14:
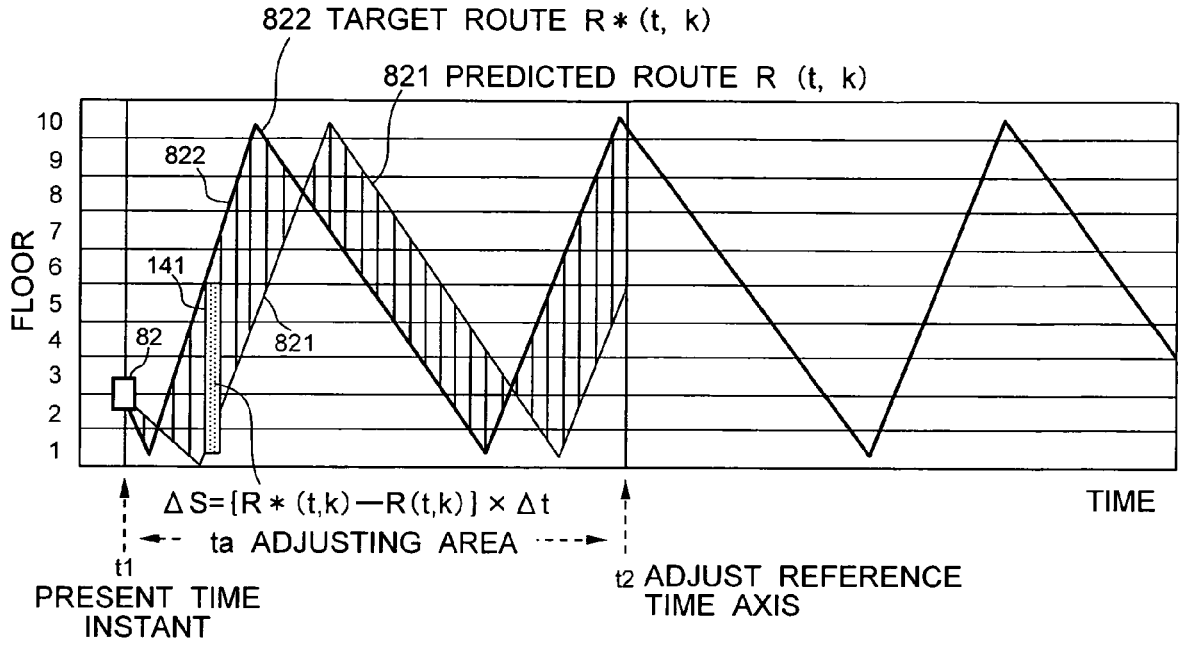
FIG. 14 is a diagram for indicating a method for calculating a route-to-route distance according to the first embodiment of the present invention.

FIG. 14 is a graph for indicating a method for calculating a route-to-route distance. In this graph, an abscissa indicates a time axis, and an ordinate shows a position of a floor. Similar to FIG. 11, the second elevator car 82 is exemplified on this graph. A target route 822 is indicated as a locus of a function "R* (t, k)", and a predicted route 821 is expressed as a locus of a function "R (t, k)". As an index which indicates a close degree between the target route 822 and the predicted route 821, it is so conceivable that the most appropriate index corresponds to an area of a region which is sandwiched by the target route 822 and the predicted route 821. Apparently, the closer both the target route 822 and the predicted route 821 are approached to each other, the smaller the area of the sandwiched region becomes. When the target route 822 is made coincident with the predicted route 821, the area of the sandwiched region becomes zero. As a consequence, such an area which is sandwiched by the function "R* (t, k)" indicative of the target route 822 and the function "R (t, k)" indicative of the predicted route 821 is defined as the route-to-route distance. The area may be calculated by an integrating method. As this integrating method, two sorts of integrating methods can be conceived, namely, an integrating method executed along the time axial direction, and another integrating method executed along the floor axial direction. FIG. 14 represents the integrating method executed along the time axial direction. This integrating formula is given as follows:

$$\int\{R^*(t, k)-R(t, k)\}dt \tag{17}$$

A time range for calculating the area is determined as a range from the present time instant "t1" up to the adjust reference axis "t2", namely, a range of an adjusting area "ta". As a result, the region whose area is calculated constitutes such a region which is indicated by longitudinal lines within such a region which is sandwiched by the target route 822, namely "R* (t, k)", and the predicted route 821, namely "R (t, k)". Assuming now that the route-to-route distance between the target route 822 and the predicted route 821 is expressed as "L [R* (t, k), R (t, k)]", this route-to-route distance "L [R* (t, k), R (t, k)]" may be expressed by the below-mentioned expression (18):

$$L[R^*(t, k), R(t, k)]=\int\{R^*(t, k)-R(t, k)\}dt \text{ (integral section corresponds to adjusting area)} \tag{18}$$

In the case that the route-to-route distance is actually calculated by using a microcomputer, or the like, the above-described integrating formula may be approximated by multiplying rectangular areas with each other. For instance, in FIG. 14, a rectangle 141 is considered, while the rectangle 141 is sandwiched by the target route 822 and the predicted route 821, and a length thereof along the time axial direction is "Δt". Assuming now that an area of this rectangle 141 is "ΔS", the area "ΔS" is expressed by the following expression (19):

$$\Delta S=\{R^*(t, k)-R(t, k)\}\times\Delta t \tag{19}$$

If the rectangle 141 is cut out from the entire adjusting area for every "Δt" and the cut rectangles 141 are multiplied with each other, then the value of the expression (19) may be calculated in an approximate manner. This method may be represented by the following expression (20):

$$L[R^*(t, k), R(t, k)]=\Sigma\Delta S=\Sigma\{R^*(t, k)-R(t, k)\}\times\Delta t \text{ (section from which rectangle is cut out corresponds to adjusting area)}$$

Next, a detailed operation of the route evaluation function calculating unit (reference numeral 33 of FIG. 1) by the route distance index will now be explained with reference to FIG. 15. The route evaluation function calculating unit 33 calculates an allocation evaluation function during provisional allocation by employing a distance between routes.

Figure 15:
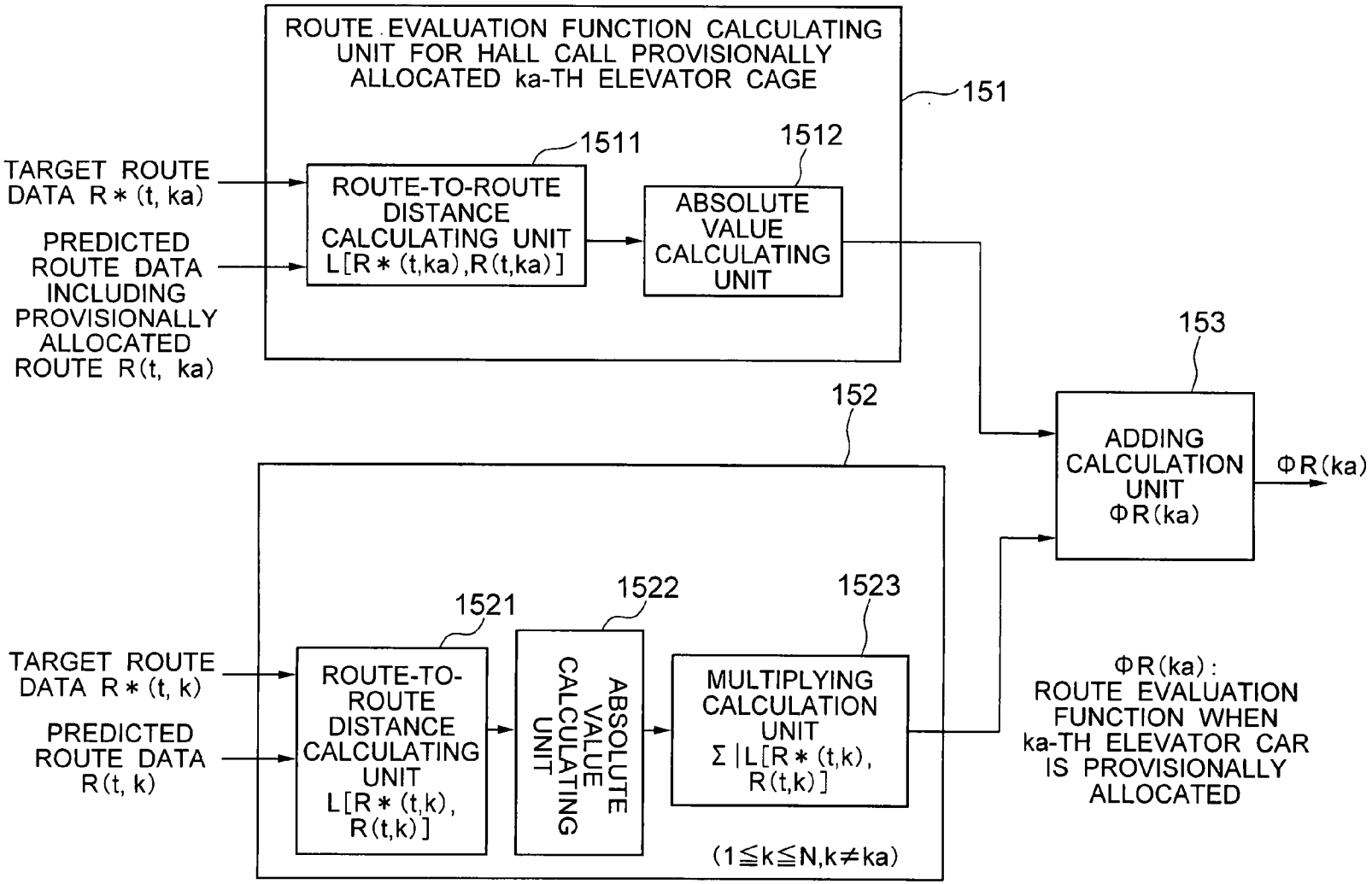
FIG. 15 is a control functional block diagram of a route evaluation function calculating unit according to the first embodiment of the present invention.

FIG. 15 is a control functional block diagram of the route evaluation function calculating unit 33 according to the first embodiment of the present invention. In this process operation, with respect to a provisionally allocated elevator cage, and other elevator cages than this provisionally allocated elevator cage, a route-to-route distance between a target route and a predicted route as to each of these elevator cages is calculated, and then, a route evaluation function is calculated based upon these calculated route-to-route distances. First, assuming now that the provisionally allocated elevator cage is a ka-th elevator car, operations as to a route evaluation function calculating unit 151 of the ka-th elevator car will now be described.

A route-to-route distance calculating unit 1511 calculates a route-to-route distance "L [R* (t, ka), R (t, ka)]" from the target route data "R* (t, ka)", and the predicted route data "R (t, ka)" in accordance with either the above-explained expression (18) or (20). In this case, the predicted route data "R (t, ka)" becomes such a route to which stopping of the provisionally allocated elevator cage has been reflected. The calculated route-to-route distance "L [R* (t, ka), R (t, ka)]" is converted into an absolute value "|L [R* (t, ka), R (t, ka)]|" by an absolute value calculating unit 1512.

Next, a description is made of a route evaluation function calculating unit 152 other than the provisionally allocated elevator car. First, in a route-to-route distance calculating unit 1521, a route-to-route distance "L [R* (t, k), R (t, k)]" is calculated from both the target route data "R* (t, k)" and the predicted route data "R (t, k)" based upon either the expression (18) or the expression (20) with respect to the k-th elevator car (1≦k≦N, "k" is not equal to "ka", and symbol "N" indicates total number of elevators). This calculated route-to-route distance "L [R* (t, k), R (t, k)]" is converted into an absolute value "|L [R* (t, k), R (t, k)]|" by an absolute value calculating unit 1522. Furthermore, route-to-route distances as to all of the elevator cages except for the ka-th elevator car are multiplied with each other in a multiply calculating unit 1523. This multiplied value is expressed by the below-mentioned expression (21):

$$\Sigma|L[R^*(t, k), R(t, k)]| \text{ (1≦k≦N, "k" is not equal to "ka", and symbol "N" indicates total number of elevators)} \tag{21}$$

In an add calculating unit 153, the calculation result of the absolute value calculating unit 1512 is added to the calculation result of the multiply calculating unit 1523, and thus, a route evaluation function "ΦR (ka)" is calculated in such a case that a hall call is provisionally allocated to the ka-th elevator car. The route evaluation function "ΦR (ka)" is represented by the below-mentioned expression (22):

$$\Phi R(ka)=|L[R^*(t, ka), R(t, ka)]|+\Sigma|L[R^*(t, k), R(t, k)]| \text{ (1≦k≦N, "k" is not equal to "ka", and symbol "N" indicates total number of elevators)} \tag{22}$$

The allocation evaluation function using the route-to-route distances as explained in this first embodiment is obtained by adding a second term of the above-described expression (22) to the provisionally allocated ka-th elevator car, while the second term corresponds to an evaluation term with respect to the elevator cages other than the provisionally allocated elevator car.

An elevator cage which is allocated to a hall call is determined based upon the route evaluation function "ΦR (ka)" in the above-explained manner. Such an elevator cage allocation whose route evaluation function "ΦR (ka)" becomes minimum with respect to N pieces of the route evaluation functions "ΦR (ka)" causes that the predicted routes are approached to the target routes of the respective elevator cages at the highest degree.

When the above-explained allocation evaluation control by the target route is employed, such a target route is formed which conducts the elevator cage to the future directed condition, and the elevator cage allocation is carried out in accordance with this formed target route. As a result, the below-mentioned effects may be achieved:

1). The temporal equi-interval control for the respective elevator cages can be realized under stable condition for a long time period.

2). The transition processes (transition conditions) can be clarified, in which the respective elevator cages are directed to the temporally equi-interval conditions.

3). The effects of the control for causing the respective elevator cages to be brought into the temporally equi-interval conditions can be clearly represented.

As a result, an occurrence of a so-called "long waiting state (for example, waiting time longer than, or equal to 1 minute)" can be suppressed. The "long waiting state" constitutes the major problem as to operations of elevators.

Figure 16:
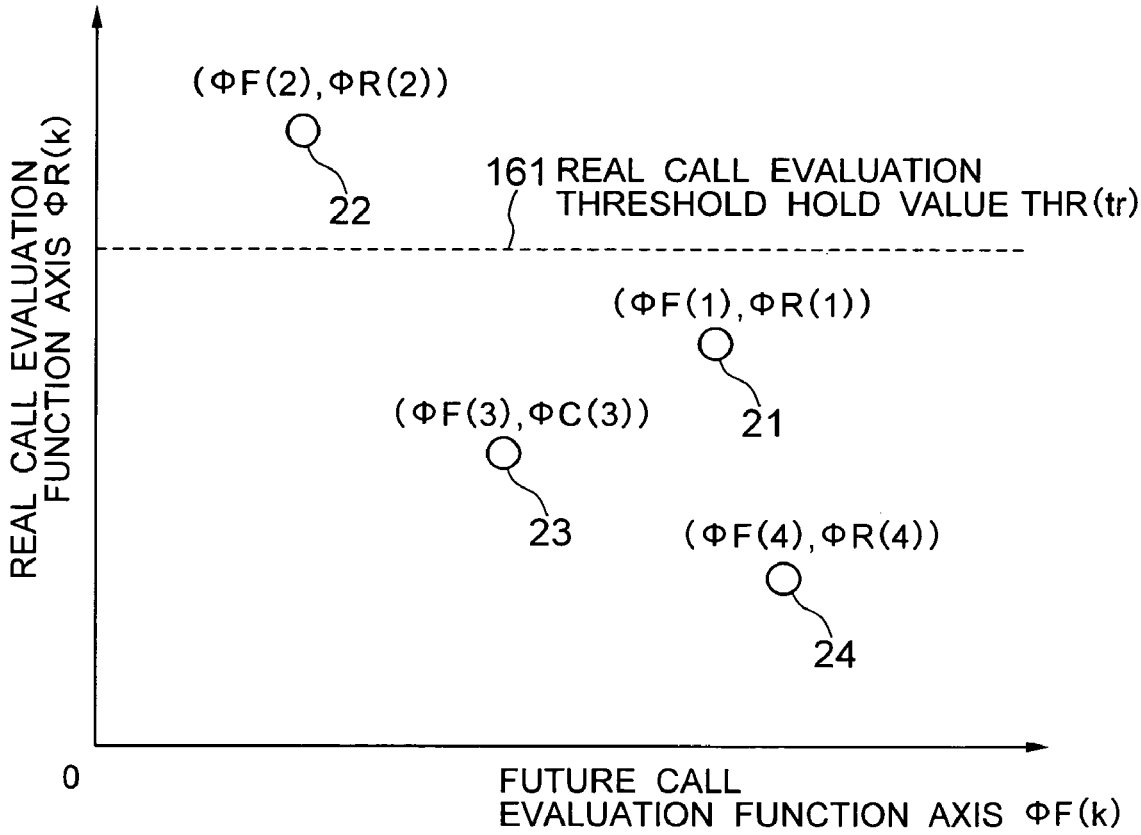
FIG. 16 is a graph for graphically showing a two-axial coordinate-to-threshold value evaluating method according to a second embodiment of the present invention.
Figure 17:
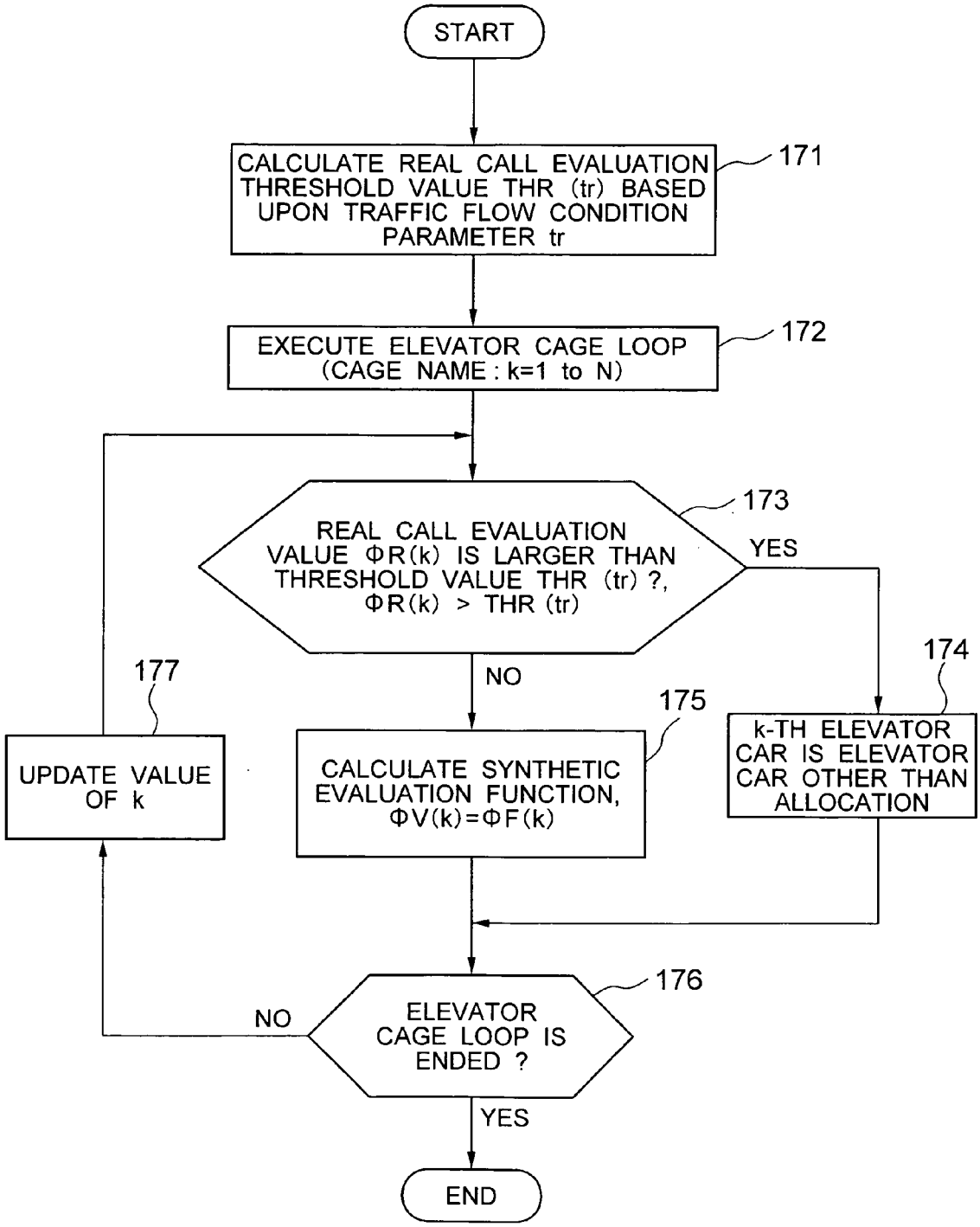
FIG. 17 is a flow chart for describing process operations of a threshold value evaluating method according to the second embodiment of the present invention.

Referring now to drawings, a second embodiment of the present invention will be described. FIG. 16 and FIG. 17 indicate drawings related to the second embodiment of the present invention, respectively.

FIG. 16 is a graph for graphically showing a two-axis coordinates-threshold value evaluating method which indicates an allocation evaluating method of an elevator group supervisory control system according to the second embodiment of the present invention. It should be understood that this graph of FIG. 16 also constitutes such a screen which is directly displayed by the display unit 7. It should also be noted that the reference numerals used in the allocation evaluating method shown in FIG. 2, will be employed as those for denoting the same elements in FIG. 16, and explanations thereof are omitted. The two-axial coordinates-threshold value evaluation method of FIG. 16 owns the following different point from that of FIG. 2. That is, a line 161 indicative of a threshold value "THR (tr)" with respect to a real call evaluation function has been set on orthogonal coordinates which are represented by both a future call evaluation function axis and the real call evaluation function axis. The allocation evaluating method based upon the orthogonal coordinate system shown in this drawing will now be explained with reference to FIG. 17.

FIG. 17 is a flow chart for explaining process operations of the threshold value evaluating method according to the second embodiment of the preset invention. First, in a step 171, while a traffic flow condition parameter "tr" is employed, a threshold value "THR (tr)" is calculated with respect to a real call evaluation function in response to a traffic flow at this time. Subsequently, in a step 172, an elevator cage loop is executed in which process operations for the respective elevators are repeatedly carried out. In the elevator cage loop, since a parameter variable "k" indicative of a car number of an elevator is changed from 1 to "N (symbol "N" indicates total number of elevators)", the process operations for the respective elevators are repeatedly carried out. In the elevator cage loop, in a step 173, first of all, a judgement is made as to whether or not a value of a real evaluation function is larger than the threshold value "THR (tr)" by using the below-mentioned expression (23):

$$\Phi R(k) > THR(tr) \tag{23}$$

In the case that the above-explained expression (23) is satisfied, a k-th elevator car ($1 \leqq k \leqq N$) is excluded from the allocation in a step 174. When the expression (23) is not satisfied, a synthetic evaluation function "ΦV (k)" which is expressed by the following expression (24) is calculated with respect to the k-th elevator car in a step 175:

$$\Phi V(k) = \Phi F(k) \tag{24}$$

In this case, the synthetic evaluation function "ΦV (k)" becomes equal to the future call evaluation function "ΦF (k)". Then, in a step 176, a judgement is made based upon a value of an elevator car "k", and when the value of the elevator car "k" becomes equal to the total car number "N", the elevator cage loop process operation is ended. To the contrary, if the value of the elevator car "k" is not equal to the total car number "N", then the value of "k" is updated in a step 177. Thereafter, a judging process operation based upon the threshold value "THR (tr)" is carried out with respect to the updated k-th elevator car in the step 173. As previously explained, the synthetic evaluation functions "ΦV (k)" are calculated with respect to the respective elevators, and then, such a k-th elevator car which gives the smallest evaluation function "ΦV (k)" is determined as a finally allocated elevator.

When this process operation is explained on the orthogonal coordinate system of FIG. 16, the below-mentioned description is given as follows: That is, it is so assumed that such a coordinate point which is located above the line 161 of the threshold value "THR (tr)" with respect to the real call evaluation is excluded from the allocation with respect to a coordinate point 21 to a coordinate point 24, which indicate evaluation results of the respective elevators on the orthogonal coordinates. Among the coordinate points located below the line 161 of the threshold value "THR (tr)", a coordinate point located at the leftmost position (namely, coordinate point whose "ΦF (k)" becomes minimum) corresponds to such an elevator whose the synthetic evaluation function "ΦV (k)" becomes minimum. In the example of FIG. 16, since the coordinate point 22 indicative of the second elevator car is located above the line 161 of the threshold value "THR (tr)", this coordinate point 22 is excluded from the allocation. Such a coordinate point which is located at the leftmost position among the remaining three coordinate points corresponds to the coordinate point 23 indicative of the third elevator car, so that the synthetic evaluation function of the third elevator car becomes minimum, and thus, this third elevator car is determined as an allocated elevator.

The above-described allocation evaluating method is featured by such a technical idea that among the real call evaluation function values smaller than, or equal to the threshold value, such an elevator whose future call evaluation value is the best value is selected. For example, in the case that a real call evaluation value is a predicted waiting time during provisional allocation, such an elevator whose future call evaluation value is the best value is selected from the elevators whose predicted waiting times can satisfy a predetermined threshold value (for instance, 45 seconds). In other words, no elevator allocation is carried out with respect to such an elevator that although future call evaluation is basically taken very seriously, a predicted waiting time of a real call exceeds the predetermined threshold value, so that it is possible to avoid that the waiting time is prolonged. The elevator allocation can be realized in which two sorts of evaluation are balanced under good condition, namely while the future call is taken very seriously, the real call is considered. Actually, in the example of FIG. 16, as to the coordinate point 22 of the second elevator car, although the future call evaluation function value "ΦF (k)" is minimum, the real call evaluation value exceeds the real call threshold value "THR (tr)", namely becomes worse. As a result, in this case of the coordinate point 22, the real call evaluation is taken very seriously, and the elevator allocation is not carried out, but such an elevator whose future call evaluation value is the best value is selected from the remaining elevators.

The line 161 of the threshold value "THR (tr)" with respect to the real call evaluation is properly changed, depending to a traffic flow condition. For instance, such a threshold value changing operation is desirable. That is, a future call is taken very seriously, and the threshold value "THR (tr)" is increased under crowded condition, and conversely, a real call is taken very seriously, and the threshold value "THR (tr)" is decreased under almost deserted condition. As explained above, the line 161 of the threshold value "THR (tr)" is moved along the upper and lower directions in response to the traffic flow at the present time, so that the balance degrees between the real call evaluation and the future call evaluation can be properly adjusted.

As previously explained, the evaluation indexes of the respective elevators are firstly represented as the coordinate points by employing such an orthogonal coordinate system that the future call evaluation function and the real call evaluation function are used as the coordinate axes, which is identical to the previous embodiment. In addition, the threshold value is represented on this orthogonal coordinate system, and the final allocation evaluation is carried out by combining therewith a small/large relationship between this threshold value and the allocation function. As a consequence, the allocation evaluation in which the future call evaluation is properly balanced with the read call evaluation can be realized. Also, as can be grasped from the graph of FIG. 16, the allocation evaluation mechanism can be displayed under easily understandable condition at first glance. As a consequence, in the case that a result of allocation evaluation with respect to a certain call is investigated, or checked, since such a display screen of FIG. 16 is viewed, it can be easily understood that the elevator allocation has been carried out based upon what reason.

Figure 18A:
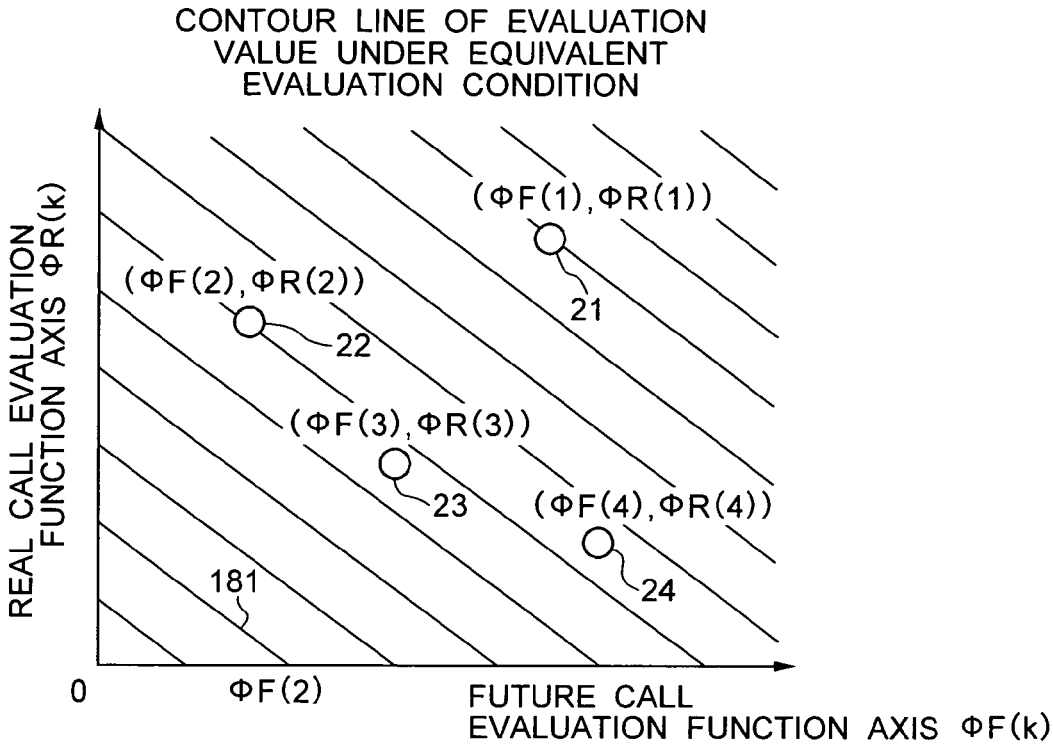
FIG. 18A is a diagram for exemplifying a representation of a two-axial coordinate-to-contour line according to a third embodiment of the present invention.
Figure 18B:
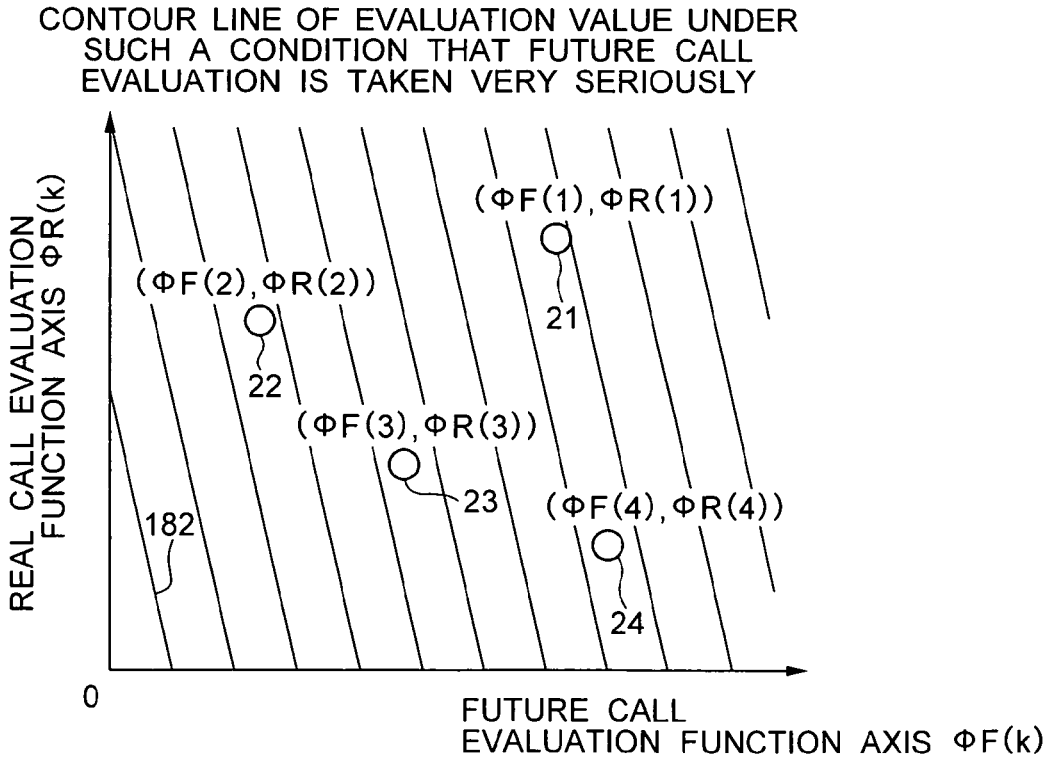
FIG. 18B is a diagram for exemplifying a representation of a two-axial coordinate-to-contour line according to a third embodiment of the present invention.

FIG. 18A and FIG. 18B indicate allocation evaluating methods of an elevator group supervisory system according to a third embodiment of the present invention. It should be understood that the graphs of FIG. 18A and FIG. 18B also constitute such screens which are directly displayed by the display unit 7. It should also be noted that the reference numerals used in the allocation evaluating method shown in FIG. 2 will be employed as those for denoting the same elements in FIG. 18A and FIG. 18B, and explanations thereof are omitted. The allocation evaluation methods shown in FIG. 18A and FIG. 18B have the following different points from that of FIG. 2, namely, a condition of a contour line 181 indicated in FIG. 18A, and a condition of a contour line 182. These contour lines 181 and 182 indicate values of synthetic evaluation functions. In FIG. 2, the contour line is the curved line, whereas in FIG. 18A and FIG. 18B, the contour lines 181 and 182 are straight lines. The contour lines 181 and 182 are obtained by expressing the synthetic evaluation function "ΦV (k)" by the below-mentioned weighting linear summation formula (25):

$$\Phi V(k)=WF(tr)\cdot\Phi F(k)+WR(tr)\cdot\Phi R(k) \tag{25}$$

As a result, an expression indicative of the contour lines 181 and 182 is given as the following expression (26):

$$WF(tr)\cdot\Phi F(k)+WR(tr)\cdot\Phi R(k)=C \tag{26}$$

In this expression (26), symbol "C" indicates a predetermined constant (positive value).

FIG. 18A exemplifies such an example that a weighting coefficient "WF (tr)" for future call evaluation is equal to a weighting coefficient "WR (tr)" for real call evaluation, namely (WF (tr)=WR (tr)). In this case, both a future call evaluation function and a real call evaluation function are equivalently evaluated. As a consequence, the third elevator car in which the summation between the future call evaluation function value "ΦF (k)" and the real call evaluation function value "ΦR (k)" is the smallest value constitutes such an elevator whose synthetic evaluation function becomes minimum. This fact can be understood at first glance from such a condition that the coordinate point 23 of the elevator which is located at the innermost position of the contour lines 181 shown in FIG. 18A.

On the other hand, FIG. 18B exemplifies such an example that a weighting coefficient "WF (tr)" for future call evaluation is larger than a weighting coefficient "WR (tr)" for real call evaluation, namely (WF (tr)>WR (tr)). This example represents that the evaluation for the future call is taken very seriously. It should be understood that an arrangement of the respective coordinate points corresponding to four elevator cars is not changed, as compared with that of FIG. 18A. Since the weighting coefficients are changed, a condition of the contour lines 182 is changed, as compared with that of the contour lines 181 shown in FIG. 18A. Different from FIG. 18A, in the case of FIG. 18B, a coordinate point which is located at the innermost position with respect to the contour lines 182 is the coordinate point 22 for indicating the second elevator car, so that this second elevator car constitutes the finally allocated elevator. When conditions of the allocation evaluation values of the second elevator are viewed, although the future call evaluation value "ΦF (2)" is minimum, the real call evaluation value is defined at the third smallest position. The reason why such a second elevator is determined as the finally allocated elevator is given as follows: That is, the future call evaluation is taken very seriously.

As previously explained, even in such a case that the synthetic evaluation function "ΦV (k)" is the weighting linear summation, since this third embodiment is employed, the mechanism of the allocation evaluation can be displayed in an easily understandable manner. In this allocation evaluation mechanism, elevator allocation is determined based upon which basis. As a result, such a reason why the relevant elevator is allocated with respect to a certain hall call can be readily understood, and also, the validity of the allocation evaluation can be checked, or investigated in an easy manner.

Figure 19:
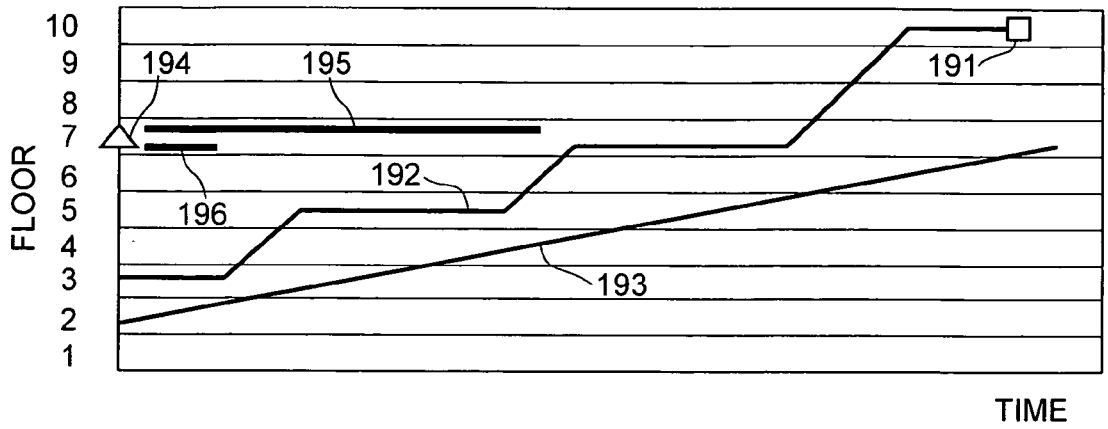
FIG. 19 is a diagram for indicating a drawing mode (No. 1) on an operating line according to another embodiment of the present invention.
Figure 20:
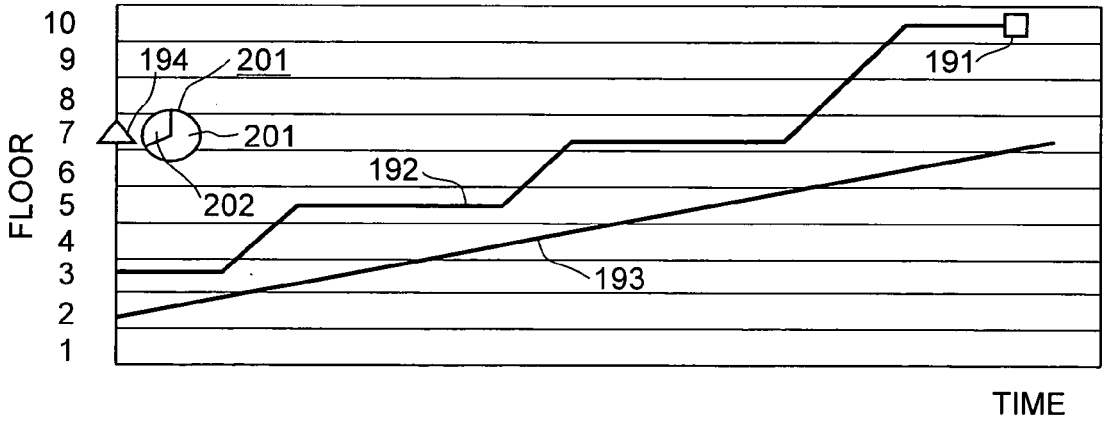
FIG. 20 is a diagram for indicating a drawing mode (No. 2) on the operating line according to another embodiment of the present invention.
Figure 21:
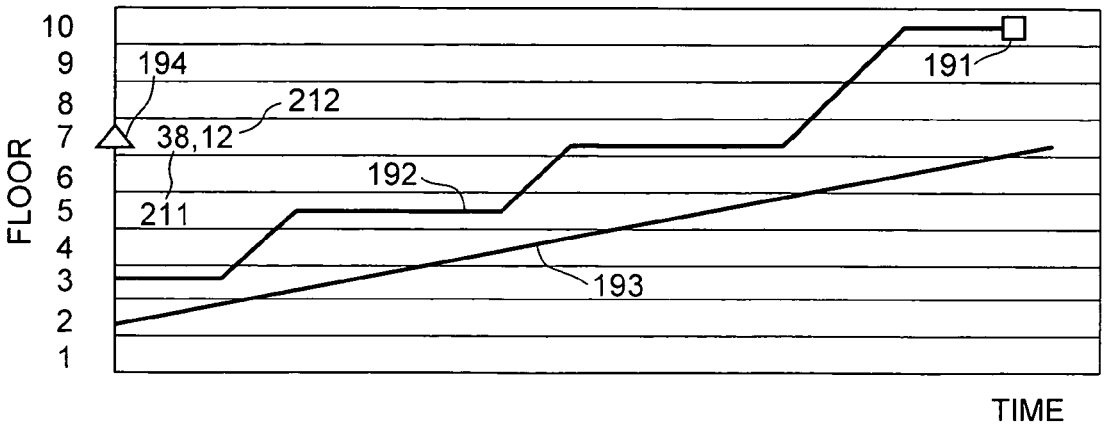
FIG. 21 is a diagram for indicating a drawing mode (No. 3) on an operating line according to another embodiment of the present invention.

FIG. 19 to FIG. 21 are diagrams for indicating drawing modes No. 1 to No. 3 on operating diagrams according to other embodiments of the present invention. These drawings indicate operating diagrams of elevators, which are displayed on a display apparatus. An operating diagram implies such a diagram that a locus along which an elevator is moved on a two-axial graphic representation where an abscissa indicates a time, an ordinate indicates a position (in unit of floor) of the elevator in a building. This operating diagram is used so as to analyze and check operations of group supervision, for example, in order to analyze a cause in the case that a long waiting call longer than, or equal to 60 seconds happens to occur. When operations of an elevator group supervisory control system are analyzed, such a diagram which is used in the highest degree corresponds to an operating diagram. Even on this operating diagram, evaluation for real calls and evaluation for future calls are expressed in these other embodiments.

Concretely speaking, in FIG. 19, a position of one elevator car which is group-supervised at a certain time is expressed by a rectangle 191, and such a locus through which this elevator passes is expressed by a locus 192. In this example, assuming now that future call evaluation has been evaluated by the previously explained target route, the target route at this time has been expressed by a locus 193. This operating diagram of FIG. 19 represents that while a hall call 194 which requests an ascending direction of a 7th floor is produced, the indicated elevator 191 is allocated to this hall call 194, and then, a serviced result is indicated. In this example, the operating diagram indicates that how evaluation results are obtained when the elevator is allocated to this hall call 194 by bar graphs 195 and 196. Firstly, a length of the bar graph 195 indicates a dimension of a real call evaluation value. Also, a length of the bar graph 196 denotes a dimension of a future call evaluation value.

In the example of FIG. 19, the elevator is stopped two times at a third floor and a fifth floor until the service is made as to the hall call 194, so that waiting time is prolonged. The reason why the hall call 194 is allocated to this elevator even if the waiting time is prolonged may be confirmed by comparing the bar graph 195 with the bar graph 196. As to the lengths of these two bar graphs 195 and 196, the length of the bar graph 196 becomes shorter. In other words, the future call evaluation value becomes smaller. As a consequence, the reason why the group supervisory control system allocates this elevator to the hall call 194 is given as follows: That is, such a point that the future call evaluation is taken very seriously and the future call evaluation value becomes smaller, is evaluated. Actually, the following fact can be revealed. That is, as compared with such a case that the hall call 194 is not allocated to the elevator, if the hall call 194 is allocated to the elevator as represented in this drawing, then the distance with respect to the target route 193 is decreased. This operating diagram of FIG. 19 represents that although the waiting time is slightly prolonged, if the produced hall call 194 is allocated to the elevator 191, then the respective elevator cars are approximated to the temporal equi-interval conditions, and thus, the service characteristic when the another elevator group supervisory control system is viewed may be improved. Since both the real call evaluation value and the future call evaluation value are indicated by the bar graphs 195 and 196 on the operating diagram in the above-explained manner, such a method for how to compare/judge both the real call evaluation value and the future call evaluation value and how to allocate the hall call 194 to the elevator can be simply grasped. It should also be noted that although the magnitudes of the evaluation values have been represented by employing the lengths of the bar graphs 195 and 196, even when these magnitudes of the evaluation values are expressed not only by the bar graphs 195 and 196, but also by lengths of lines such as straight lines and waved lines, the same effect may be achieved.

FIG. 20 indicates such an example that contents of allocation evaluation are represented by a circle graph 201 instead of a bar graph on the operating diagram. It should be noted that the same reference numerals shown in FIG. 19 will be employed as those for denoting the same elements of FIG. 20, and explanations thereof are omitted. In FIG. 20, the circle graph 201 represents contents of both a real call evaluation value 201 and a future call evaluation value 202 with respect to the hall call 194. In the case shown in FIG. 20, since the future call evaluation value 202 is small, although a waiting time becomes slightly long by considering the entire elevator group supervisory control system, such an elevator that the future call evaluation value 202 becomes small is allocated with respect to the hall call 194.

FIG. 21 indicates such an example that contents of direct allocation evaluation are expressed by numeral values on the operating diagram. It should be noted that the same reference numerals shown in FIG. 19 will be employed as those for denoting the same elements of FIG. 21, and explanations thereof are omitted. In FIG. 21, two numeral values positioned side by side indicate a real call evaluation value 211 and a future call evaluation value 212 with respect to the hall call 194, respectively. Also, in this case, as explained with reference to FIG. 19, the reason why the elevator group supervisory control system allocates the elevator 191 with respect to the hall call 194 can be readily grasped by comparing the numeral values with each other.

As previously descried, in such a case that the elevator group supervisory control system, according to the embodiment of the present invention, selects the allocated elevator by employing the plurality of evaluation indexes whose view points are different from each other, the correspondence relationship among the respective evaluation indexes, and the relative conditions of these evaluation indexes with respect to the respective elevators, and further, the balance between them can be understood at first glance. As a consequence, the evaluation method capable of easily grasping the mechanism of the elevator allocation can be realized. Also, since the display apparatus for displaying thereon the evaluation results is equipped in the elevator group managing system, the reason why the relevant elevator is allocated to a certain hall call can be readily understood, and also, the validity of the allocation evaluation can be checked, or investigated.

The invention claimed is:

1. An elevator group supervisory control method for supervising a plurality of elevators, comprising:

a step for forming multi-dimensional coordinates in which a plurality of allocation evaluation indexes having different view points are defined as coordinate axes thereof, respectively;

a step for representing contour lines of a third allocation evaluation index on orthogonal two-dimensional coordinates in which a first allocation evaluation index and a second allocation evaluation index, which contain different view points, are defined as coordinate axes respectively, said contour lines of the third allocation evaluation index being indicated by a relationship between said first and second allocation evaluation indexes; and a step for evaluating the allocation of the respective elevators based upon said contour lines.

2. An elevator group supervisory control method for supervising a plurality of elevators, comprising:

a step for forming multi-dimensional coordinates in which a plurality of allocation evaluation indexes having different view points are defined as coordinate axes thereof, respectively;

a step for representing contour lines of a third allocation evaluation index on orthogonal two-dimensional coordinates in which a first allocation evaluation index and a second allocation evaluation index, which contain different view points, are defined as coordinate axes respectively, said contour lines of the third allocation evaluation index being indicated by a relationship between said first and second allocation evaluation indexes;

a step for representing evaluation indexes with respect to each of the plural elevators in the case that the respective elevators are allocated to a hall call as coordinate points on said two-dimensional coordinates; and a step for evaluating allocation of the respective elevators based upon a positional relationship between said coordinate points and said contour lines.

3. An elevator group supervisory control system for supervising a plurality of elevators, comprising:

means for forming multi-dimensional coordinates in which a plurality of allocation evaluation indexes having different view points are defined as coordinate axes thereof, respectively;

contour lines display means for displaying contour lines of a third allocation evaluation index on orthogonal two-dimensional coordinates in which a first allocation evaluation index and a second allocation evaluation index, which contain different view points, are defined as coordinate axes respectively, said contour lines of the third allocation evaluation index being indicated by a relationship between said first and second allocation evaluation indexes; and evaluation means for evaluating the allocation evaluation index based upon said contour lines.

4. An elevator group supervisory control system for supervising a plurality of elevators, comprising:

means for forming multi-dimensional coordinates in which a plurality of allocation evaluation indexes having different view points are defined as coordinate axes thereof, respectively;

contour lines display means for displaying contour lines of a third allocation evaluation index on orthogonal two-dimensional coordinates in which a first allocation evaluation index and a second allocation evaluation index, which contain different view points, are defined as coordinate axes respectively, said contour lines of the third allocation evaluation index being indicated by a relationship between said first and second allocation evaluation indexes;

coordinate point representing means for representing evaluation indexes with respect to each of the plural elevators in the case that the respective elevators are allocated to a hall call as coordinate points on said two-dimensional coordinates; and evaluation means for evaluating the allocation evaluation indexes based upon a positional relationship between said coordinate points and said contour lines.

5. An elevator group supervisory control system as claimed in claim 4, further comprising:

means for changing said contour lines in response to a traffic flow condition within a building.

6. An elevator group supervisory control system for supervising a plurality of elevators, comprising:

means for forming multi-dimensional coordinates in which a plurality of allocation evaluation indexes having different view points are defined as coordinate axes thereof, respectively;

means for representing evaluation indexes with respect to each of the plural elevators in the case that the respective elevators are allocated to a hall call as coordinate points on said multi-dimensional coordinates;

means for indicating a threshold value with respect to at least one of the coordinate axes of said multi-dimensional coordinates; and means for selecting an allocation elevator based upon a positional relationship between said threshold value and the coordinate points of the evaluation indexes for the respective elevators on said multi-dimensional coordinates.

7. An elevator group supervisory control system as claimed in claim 6, further comprising:

means for changing said threshold value in response to a traffic flow condition within a building.

8. An elevator group supervisory control system for supervising a plurality of elevators, comprising:

means for forming multi-dimensional coordinates in which a plurality of allocation evaluation indexes having different view points are defined as coordinate axes thereof, respectively, wherein one of said plural allocation evaluation indexes is an evaluation index which is related to an unequal characteristic of intervals among the plural elevators;

means for representing evaluation indexes with respect to the plural elevators when the respective elevators are allocated to a hall call as coordinate points on said multi-dimensional coordinates; and means for selecting an allocation elevator based upon a correlative positional relationship among the coordinate points of the evaluation indexes for the respective elevators on said multi-dimensional coordinates.

* * * * *